US008333366B2

(12) United States Patent
Jury et al.

(10) Patent No.: US 8,333,366 B2
(45) Date of Patent: Dec. 18, 2012

(54) CARBURETOR INCLUDING ONE-PIECE FUEL-METERING INSERT

(75) Inventors: Brett W. Jury, Elm Grove, WI (US); David D. Roth, North Fond du Lac, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 470 days.

(21) Appl. No.: 12/719,103

(22) Filed: Mar. 8, 2010

(65) Prior Publication Data

US 2011/0215486 A1 Sep. 8, 2011

(51) Int. Cl.
*F02M 17/36* (2006.01)
*F02M 19/06* (2006.01)

(52) U.S. Cl. ..... 261/66; 261/72.1

(58) Field of Classification Search ..... 261/66, 261/67, 72.1, 74, 75
See application file for complete search history.

(56) References Cited

U.S. PATENT DOCUMENTS

| | | | | |
|---|---|---|---|---|
| 1,435,578 | A | 11/1922 | Baldwin | |
| 1,631,716 | A | 6/1927 | Baverey | |
| 1,850,307 | A | 3/1932 | Moore | |
| 1,858,835 | A | 5/1932 | Mabee et al. | |
| 1,929,266 | A * | 10/1933 | Viel | 261/41.5 |
| 1,945,462 | A | 1/1934 | Roualet | |
| 1,971,527 | A | 8/1934 | Kennedy | |
| 2,273,979 | A * | 2/1942 | Mock | 261/1 |
| 3,093,699 | A * | 6/1963 | Demitz | 261/65 |
| 3,168,599 | A * | 2/1965 | Marsee et al. | 261/65 |
| 3,780,996 | A | 12/1973 | Nutten | |
| 3,963,808 | A | 6/1976 | Garcea | |
| 4,040,399 | A | 8/1977 | Meininger | |
| 4,150,070 | A * | 4/1979 | Hashimoto et al. | 261/41.4 |
| 4,229,384 | A | 10/1980 | Karino et al. | |
| 4,250,125 | A | 2/1981 | Donovan | |
| 4,333,890 | A | 6/1982 | Karino et al. | |
| 4,347,822 | A | 9/1982 | Casey | |
| 4,353,847 | A | 10/1982 | Sato et al. | |
| 4,366,704 | A | 1/1983 | Sato et al. | |
| 4,382,047 | A | 5/1983 | Brown et al. | |
| 4,411,844 | A | 10/1983 | Morris et al. | |

(Continued)

FOREIGN PATENT DOCUMENTS

| | | | | |
|---|---|---|---|---|
| JP | 57-135249 A * | 8/1982 | | 261/66 |

(Continued)

OTHER PUBLICATIONS

Prior art carburetor publicly introduced at least as early as Oct. 25, 1983, 5 pages.

*Primary Examiner* — Richard L Chiesa
(74) *Attorney, Agent, or Firm* — Michael Best & Friedrich LLP

(57) ABSTRACT

A carburetor includes a body, a throttle valve positioned in an air/fuel passageway in the body, a fuel bowl coupled to the body, a fuel bowl chamber at least partially defined by the fuel bowl, and a one-piece fuel-metering insert coupled to the body. The insert includes an idle circuit passageway having a first end in fluid communication with a fuel passageway in the body and a second end in fluid communication with the fuel bowl chamber. The insert also includes a main circuit passageway having a first end in fluid communication with the air/fuel passageway and a second end in fluid communication with the fuel bowl chamber.

29 Claims, 20 Drawing Sheets

U.S. PATENT DOCUMENTS

| | | | | |
|---|---|---|---|---|
| 4,464,312 | A * | 8/1984 | Zaita | 261/70 |
| 4,836,506 | A | 6/1989 | Hundertmark | |
| 4,960,545 | A | 10/1990 | Morini | |
| 5,049,318 | A | 9/1991 | Guntly et al. | |
| 5,128,071 | A | 7/1992 | Smith et al. | |
| 5,150,673 | A | 9/1992 | Hoshiba et al. | |
| 5,667,730 | A * | 9/1997 | Barfield | 261/18.3 |
| 5,807,512 | A | 9/1998 | Grant | |
| 5,863,470 | A | 1/1999 | Grant | |
| 6,435,482 | B1 | 8/2002 | Omi et al. | |
| 6,454,246 | B1 | 9/2002 | Grifka et al. | |
| 6,499,726 | B2 | 12/2002 | Clements | |
| 6,513,794 | B2 | 2/2003 | Clements et al. | |
| 6,702,262 | B2 | 3/2004 | Nonaka | |
| 6,845,972 | B2 | 1/2005 | Nonaka | |
| 6,866,019 | B1 | 3/2005 | Schmitz | |
| 7,090,203 | B2 | 8/2006 | Goto | |
| 7,152,852 | B1 | 12/2006 | Habu et al. | |
| 7,165,536 | B2 | 1/2007 | Kirk et al. | |
| 7,168,690 | B2 * | 1/2007 | Grant | 261/23.2 |
| 7,513,487 | B2 | 4/2009 | Saito | |
| 2005/0062176 | A1 | 3/2005 | Nonaka | |
| 2007/0013086 | A1 * | 1/2007 | Cooper | 261/70 |

FOREIGN PATENT DOCUMENTS

| | | |
|---|---|---|
| JP | 59007760 | 1/1984 |
| JP | 63-302168 | 12/1988 |
| JP | 3074554 | 3/1991 |
| JP | 2001027154 | 1/2001 |
| JP | 2001027156 | 1/2001 |

* cited by examiner

CARBURETOR INCLUDING ONE-PIECE FUEL-METERING INSERT

FIELD OF THE INVENTION

The present invention relates to internal combustion engines, and more particularly to carburetors for use with internal combustion engines.

BACKGROUND OF THE INVENTION

Small engines for use with, for example, outdoor power equipment (e.g., walk-behind mowers, etc.) typically utilize carburetors for supplying a mixture of air and fuel to the engine. Such carburetors typically include die-cast metal bodies and many small parts that are assembled to the body. Many machining processes are also often employed on the die-cast metal bodies in preparation for final assembly.

Other carburetors, however, include bodies that are molded from a plastic material. Such molded plastic carburetor bodies often include one or more apertures or passageways formed therein which otherwise would be machined in an equivalent die-cast metal carburetor body. However, such molded plastic carburetor bodies typically require some machining in preparation for final assembly of the carburetor. For example, it is common to employ one or more drilling processes in conventional molded plastic carburetor bodies to form connecting passageways between two or more molded passageways. Subsequent manufacturing processes, such as plugging a portion of the drilled passageway and welding the plug to the carburetor body, are also commonly employed in manufacturing carburetors having molded plastic bodies.

SUMMARY OF THE INVENTION

The present invention provides, in one aspect, a carburetor for use with an internal combustion engine. The carburetor includes a body having an air/fuel passageway and a fuel passageway formed therein, a throttle valve positioned in the air/fuel passageway, a fuel bowl coupled to the body, a fuel bowl chamber at least partially defined by the fuel bowl, and a one-piece fuel-metering insert coupled to the body. The insert includes an idle circuit passageway having a first end in fluid communication with the fuel passageway and a second end in fluid communication with the fuel bowl chamber. The idle circuit passageway is configured to carry fuel from the fuel bowl chamber to the air/fuel passageway via the fuel passageway during engine operation when the throttle valve is oriented in a substantially closed position. The insert also includes a main circuit passageway having a first end in fluid communication with the air/fuel passageway and a second end in fluid communication with the fuel bowl chamber. The main circuit passageway is configured to carry fuel from the fuel bowl chamber to the air/fuel passageway during engine operation when the throttle valve is opened from the substantially closed position.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
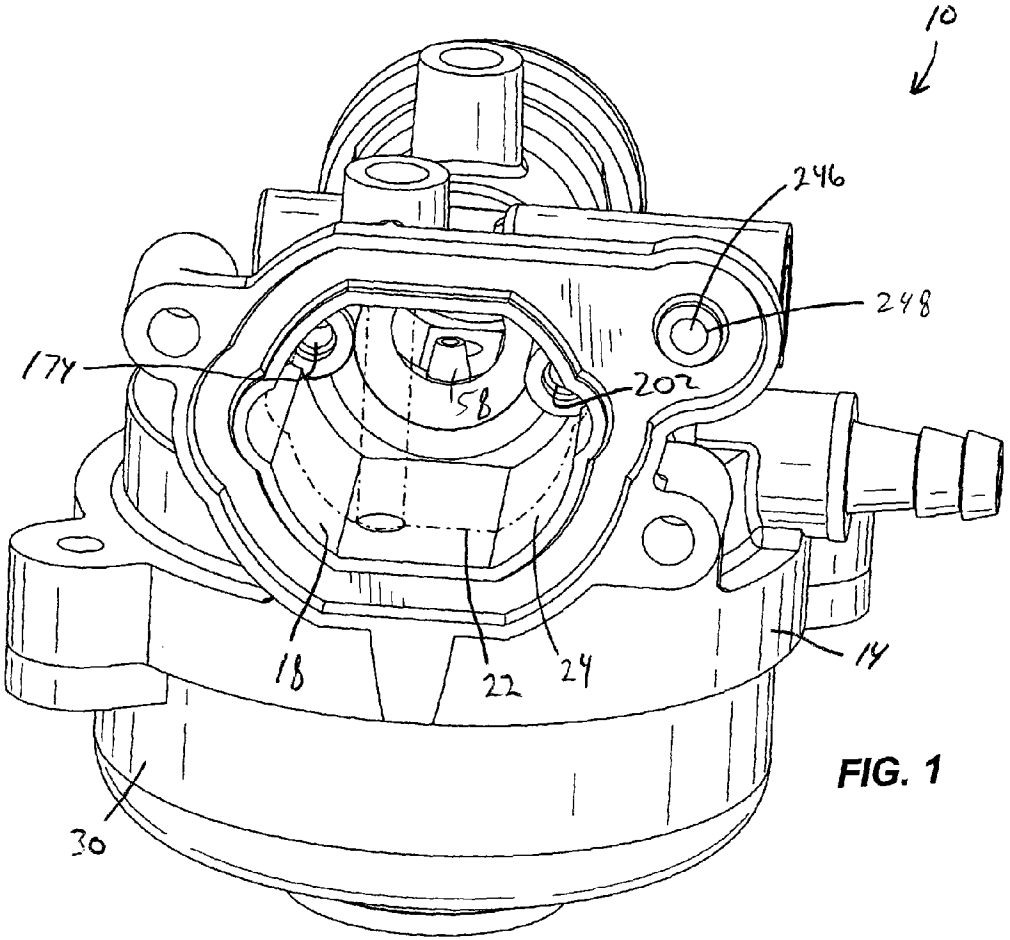
FIG. 1 is a perspective view of a first end of a first construction of a carburetor according to the invention, illustrating an air/fuel passageway and a choke valve in the air/fuel passageway.
Figure 2:
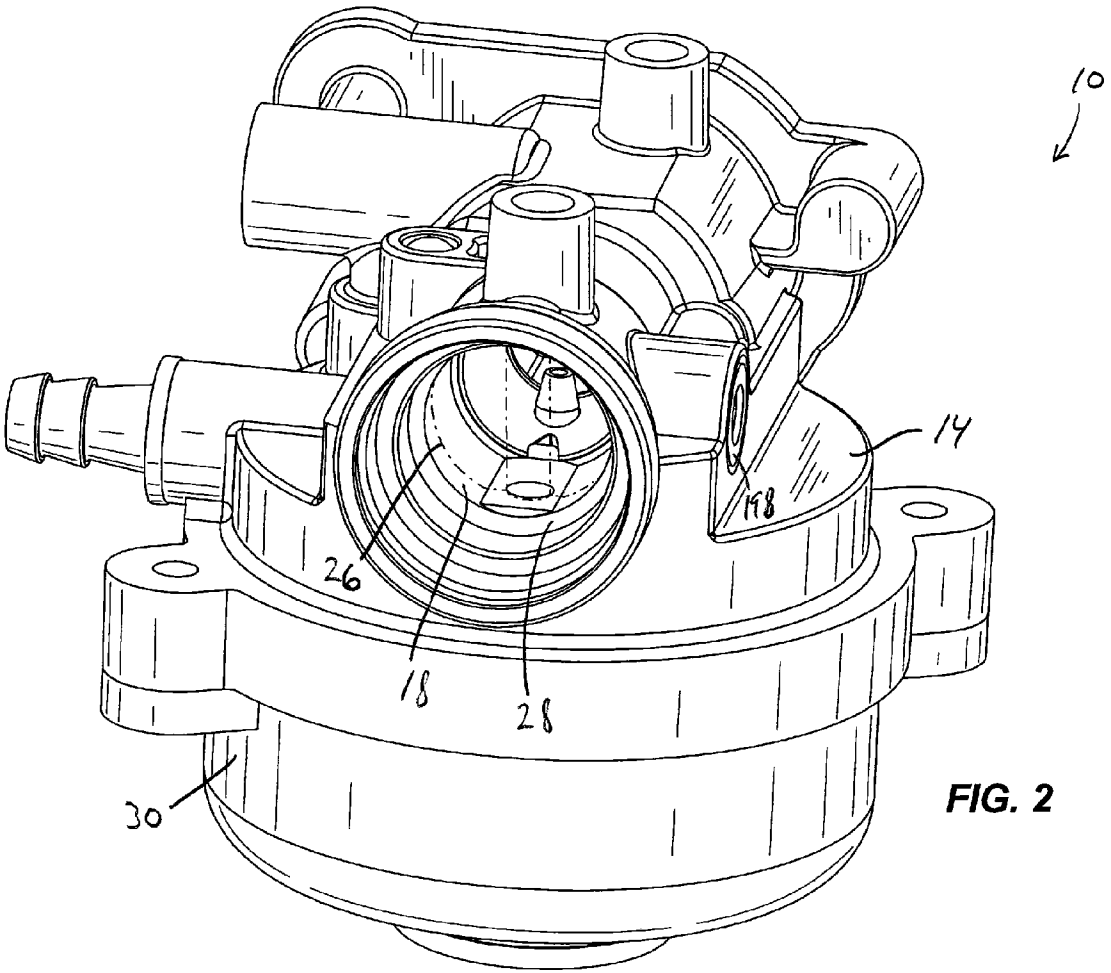
FIG. 2 is a perspective view of a second end of the carburetor of FIG. 1, illustrating a throttle valve in the air/fuel passageway.

FIGS. 1 and 2 illustrate a first construction of a carburetor 10 configured for use with a small internal combustion engine. Such an engine may be utilized in outdoor power equipment (e.g., a lawnmower, snow thrower, etc.) or other types of engine-powered equipment (e.g., a generator). The carburetor 10 includes a body 14 defining an air/fuel passageway 18 in which a mixture of fuel and air is created for consumption by the engine. The body 14 is made of a single piece of plastic material using a molding process, with the exception of a few fittings or plugs coupled to the body 14 after it is molded. Alternatively, the body 14 may be made from metal as a single piece using a casting process. The carburetor 10 includes a choke valve 22 (FIG. 1) positioned in an upstream portion 24 of the passageway 18, and a throttle valve 26 (FIG. 2) positioned in a downstream portion 28 of the passageway 18. Movement of the choke valve 22 and throttle valve 26 may be controlled in a conventional manner using mechanical linkages (e.g., shafts, arms, cables, etc.). Alternatively, the choke valve 22 may be omitted.

Figure 3:
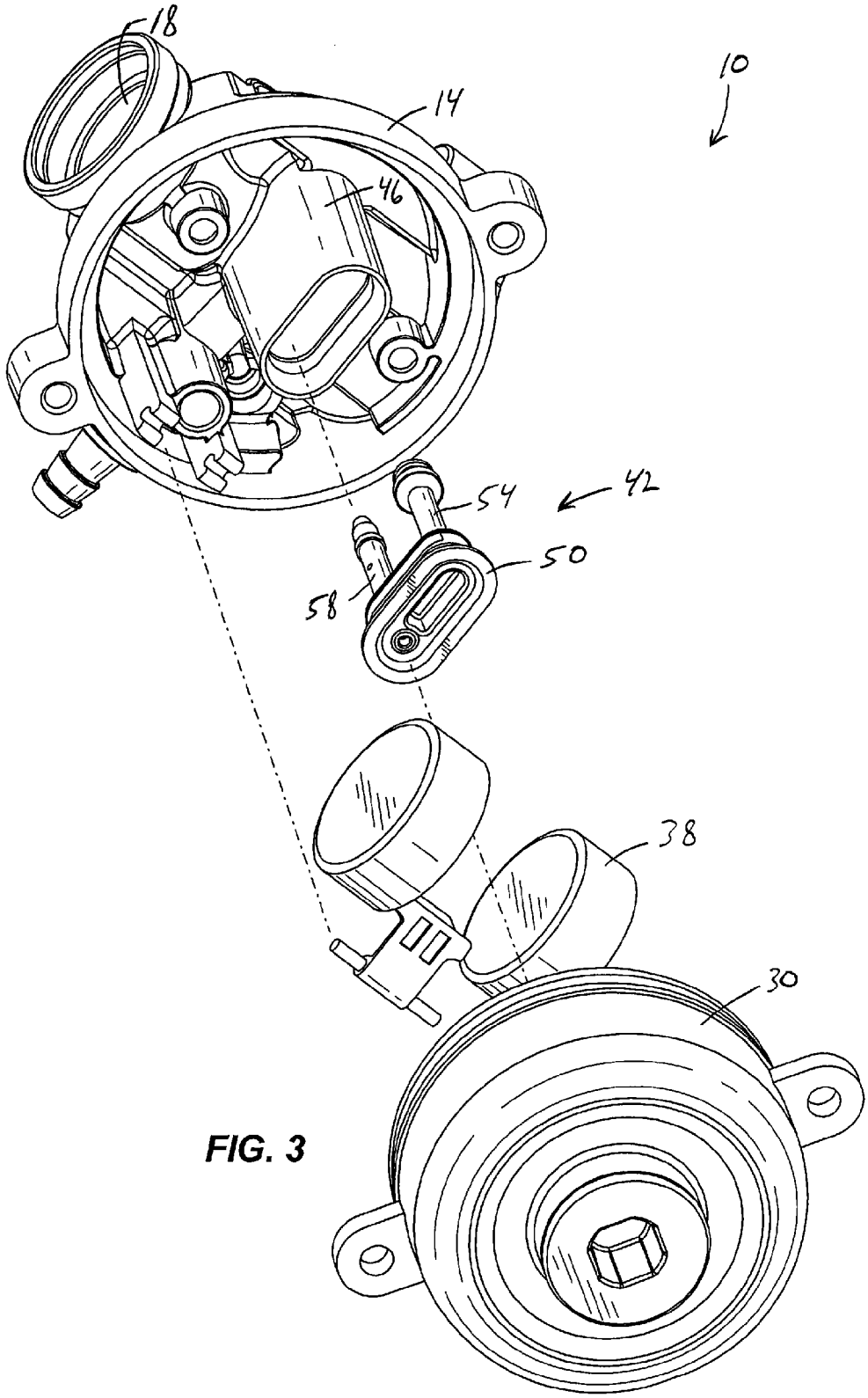
FIG. 3 is an exploded, bottom perspective view of the carburetor of FIG. 1, illustrating a one-piece fuel-metering insert.
Figure 5:
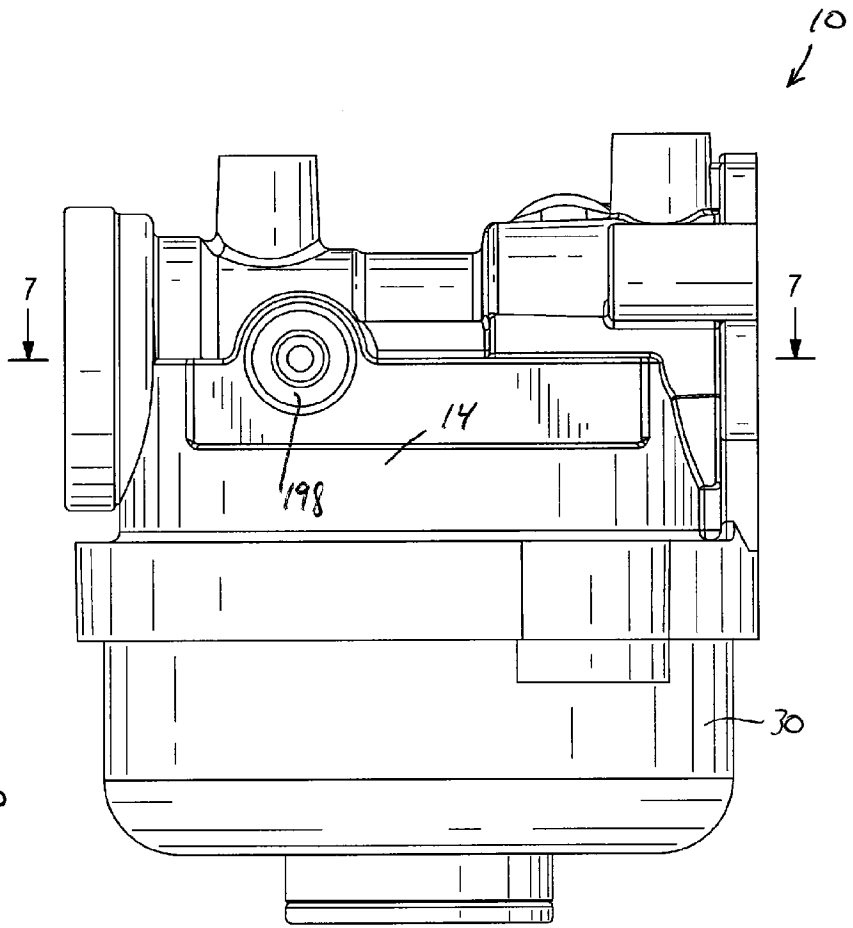
FIG. 5 is an assembled, side view of the carburetor of FIG. 1.
Figure 8:
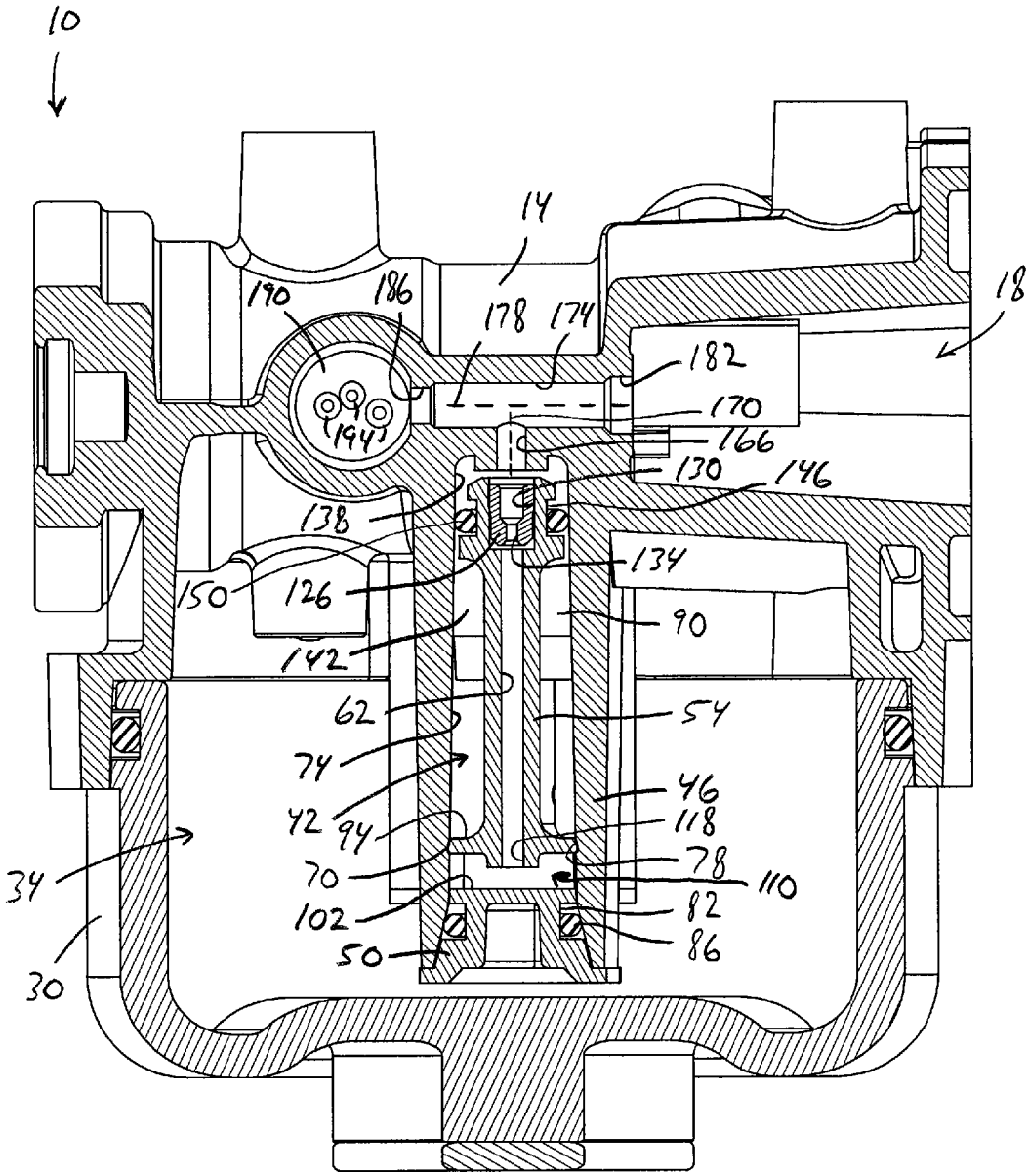
FIG. 8 is a cross-sectional view of the carburetor of FIG. 1 taken along line 8-8 in FIG. 6.

With reference to FIG. 3, the carburetor 10 also includes a fuel bowl 30 coupled to the body 14. The body 14 and the fuel bowl 30 define a fuel bowl chamber 34 in which fuel is stored (FIG. 8). The carburetor 10 also includes a float 38 pivotably coupled to the body 14 (FIG. 3). The float 38 is operable in a conventional manner in conjunction with a valve (not shown) to meter the amount of fuel introduced into the fuel bowl chamber 34. Alternatively, the carburetor 10 may include different structure, besides the float 38, with which to meter the amount of fuel introduced into the fuel bowl chamber 34.

Figure 4:
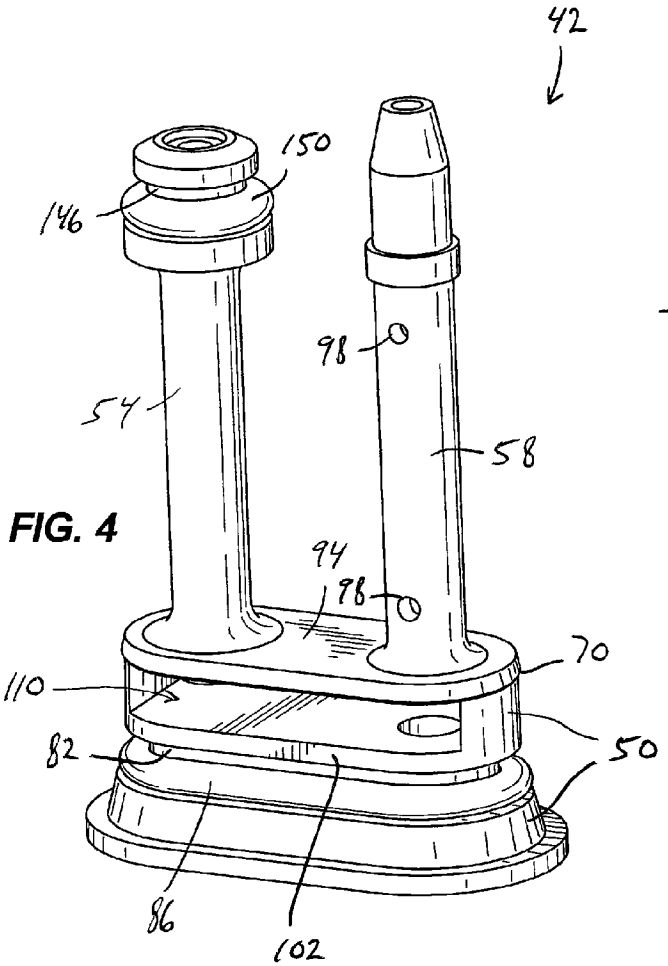
FIG. 4 is a front perspective view of the fuel-metering insert of FIG. 3.
Figure 10:
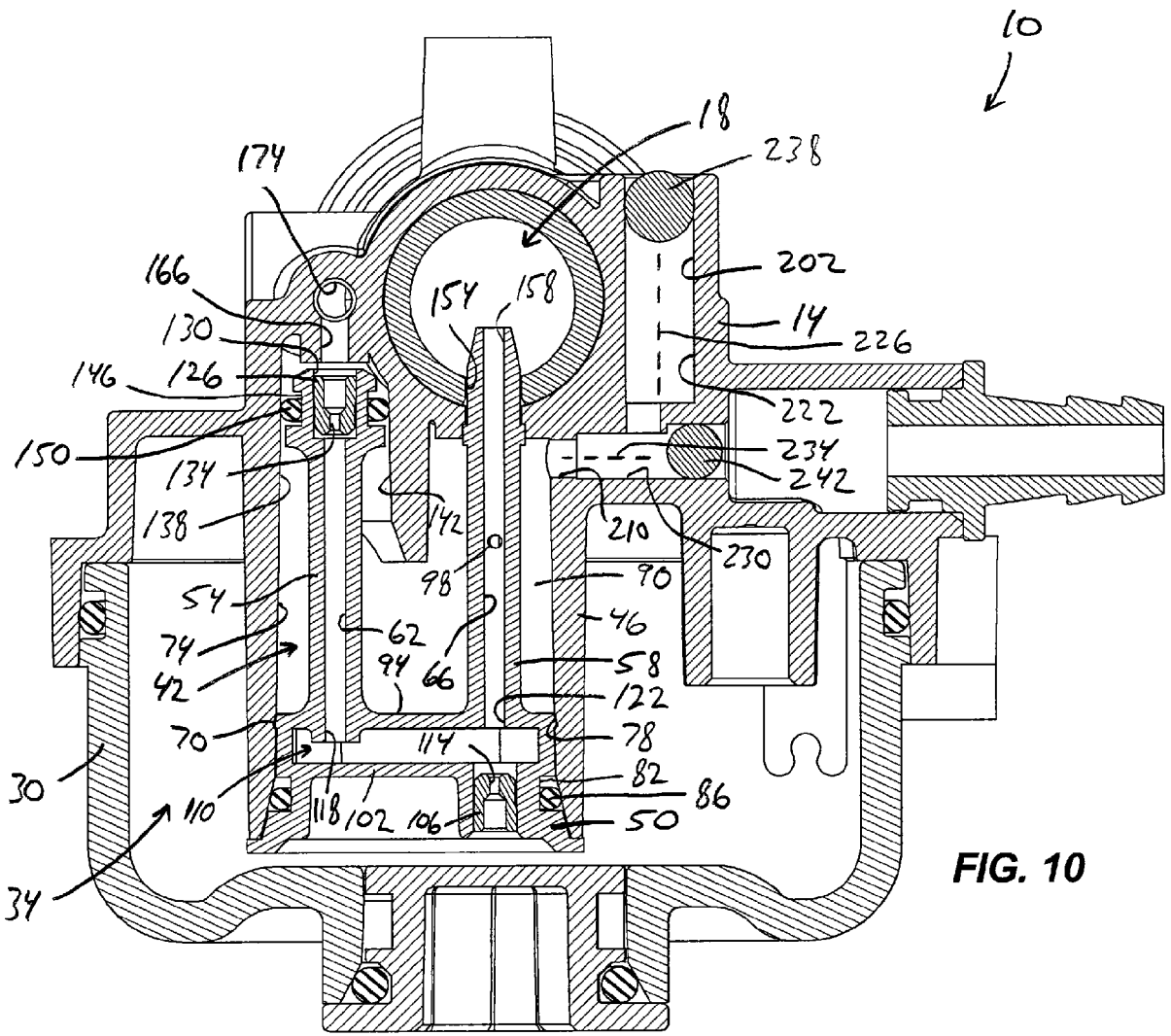
FIG. 10 is a cross-sectional view of the carburetor of FIG. 1 taken along line 10-10 in FIG. 6.

With reference to FIGS. 3 and 4, the carburetor 10 also includes a fuel-metering insert 42 coupled to a stem 46 on the body 14. As shown in FIG. 4, the insert 42 includes a base 50, an idle circuit conduit 54 extending from the base 50, and a main circuit conduit 58 extending from the base 50. In the illustrated construction of the carburetor 10, the insert 42 is formed as a single piece of plastic material using a molding process. Alternatively, the insert 42 may be made from metal as a single piece using a casting process. With reference to FIG. 10, the idle circuit conduit 54 defines therein an idle circuit passageway 62 through which fuel flows from the fuel bowl chamber 34 to the air/fuel passageway 18 when the throttle valve 26 is oriented in a substantially closed position corresponding with an idle speed of the associated engine. The main circuit conduit 58 defines therein a main circuit passageway 66 through which fuel flows from the fuel bowl chamber 34 to the air/fuel passageway 18 when the throttle valve 26 is opened from its substantially closed position when the associated engine is operating at part throttle or full throttle.

With continued reference to FIG. 10, the stem 46 extends into the fuel bowl chamber 34, and the insert 42 is supported within the interior of the stem 46. In the illustrated construction of the carburetor 10, the insert 42 is coupled and secured to the stem 46 using a snap-fit. Specifically, the insert 42 includes a lip 70 formed around the outer periphery of the base 50, and the stem 46 includes an interior wall 74 defining therein a groove 78 in which the lip 70 is received. As such, the insertion of the lip 70 into the groove 78 provides an indication (e.g., with an audible click) during assembly that the insert 42 is fully inserted within the stem 46. The configuration of the lip 70 and the groove 78 also substantially prevents unintentional removal of the insert 42 from the stem 46, effectively permanently securing the insert 42 to the carburetor body 14. Alternatively, the lip 70 may be formed on the interior wall 74, and the groove 78 may be formed in the outer periphery of the base 50 of the insert 42. As a further alternative, the stem 46 and the insert 42 may utilize any of a number of different structural features or components with which to couple and secure the insert 42 to the stem 46. Likewise, any of a number of different processes may be employed to couple and secure the insert 42 to the stem 46 (e.g., using an interference fit, using adhesives, welding, etc.).

With continued reference to FIG. 10, the base 50 of the insert 42 includes a groove 82 in which a seal 86 (e.g., an O-ring) is positioned. The seal 86 is engaged with the interior wall 74 of the stem 46 about the inner periphery of the stem 46 to substantially prevent fuel from leaking between the insert 42 and the interior wall 74 of the stem 46. In addition, the combination of the lip 70 and the groove 78 also functions as a seal to substantially prevent fuel from leaking between the insert 42 and the interior wall 74 of the stem 46. Consequently, the stem 46 and the insert 42 at least partially define an air chamber 90, located above the insert 42, within the interior of the stem 46. Specifically, the lower extent of the air chamber 90 is defined by an upper wall 94 of the base 50 from which the idle circuit conduit 54 and the main circuit conduit 58 extend. The main circuit conduit 58 includes a plurality of apertures 98 fluidly communicating the main circuit passageway 66 and the air chamber 90, the function of which is described in more detail below.

With continued reference to FIG. 10, the insert 42 includes a lower wall 102 spaced from the upper wall 94, and a jet 106 supported by the lower wall 102. The walls 94, 102 define therebetween a fuel reservoir 110, and the jet 106 includes an orifice 114 sized to meter fuel flow from the fuel bowl chamber 34 to the fuel reservoir 110. In the illustrated construction of the carburetor 10, the jet 106 is configured as a separate and distinct component from the insert 42 that is coupled to the insert 42 (e.g., using a press-fit or an interference fit, using adhesives, by welding, etc.). Alternatively, the jet 106 may be omitted, and the lower wall 102 may include an orifice substantially identical to the orifice 114 in the jet 106 to meter fuel flow from the fuel bowl chamber 34 to the fuel reservoir 110.

Respective ends 118, 122 of the idle circuit passageway 62 and the main circuit passageway 66 are in fluid communication with the fuel reservoir 110 to draw fuel directly from the fuel 110 reservoir during operation of the engine incorporating the carburetor 10. Another jet 126 is coupled to the idle circuit conduit 54 at a location proximate an opposite end 130 of the idle circuit passageway 62. The jet 126 includes an orifice 134 sized to meter fuel flow that is discharged from or exiting the idle circuit passageway 62. In the illustrated construction of the carburetor 10, the jet 126 is configured as a separate and distinct component from the insert 42 that is coupled to the insert 42 (e.g., using a press-fit or an interference fit, using adhesives, by welding, etc.). Alternatively, the jet 126 may be omitted, and the end 130 of the idle circuit passageway 62 may be formed to include an orifice substantially identical to the orifice 134 in the jet 126 to meter fuel flow exiting the idle circuit passageway 62.

With continued reference to FIG. 10, the carburetor body 14 includes a receptacle 138 within the stem 46 into which the idle circuit conduit 54 is at least partially received. In the illustrated construction of the carburetor 10, the receptacle 138 is at least partially defined by the interior wall 74 of the stem 46 and an arcuate wall 142 extending from the carburetor body 14 toward the fuel bowl 30. Alternatively, the receptacle 138 may be defined by different structure of the carburetor body 14. The idle circuit conduit 54 includes a groove 146 in which a seal 150 (e.g., an O-ring) is positioned. A portion of the seal 150 is engaged with the interior wall 74 of the stem 46, and the remaining portion of the seal 150 is engaged with the arcuate wall 142 to substantially prevent fuel exiting the idle circuit passageway 62 from leaking between the idle circuit conduit 54, the interior wall 74, and the arcuate wall 142.

Figure 7:
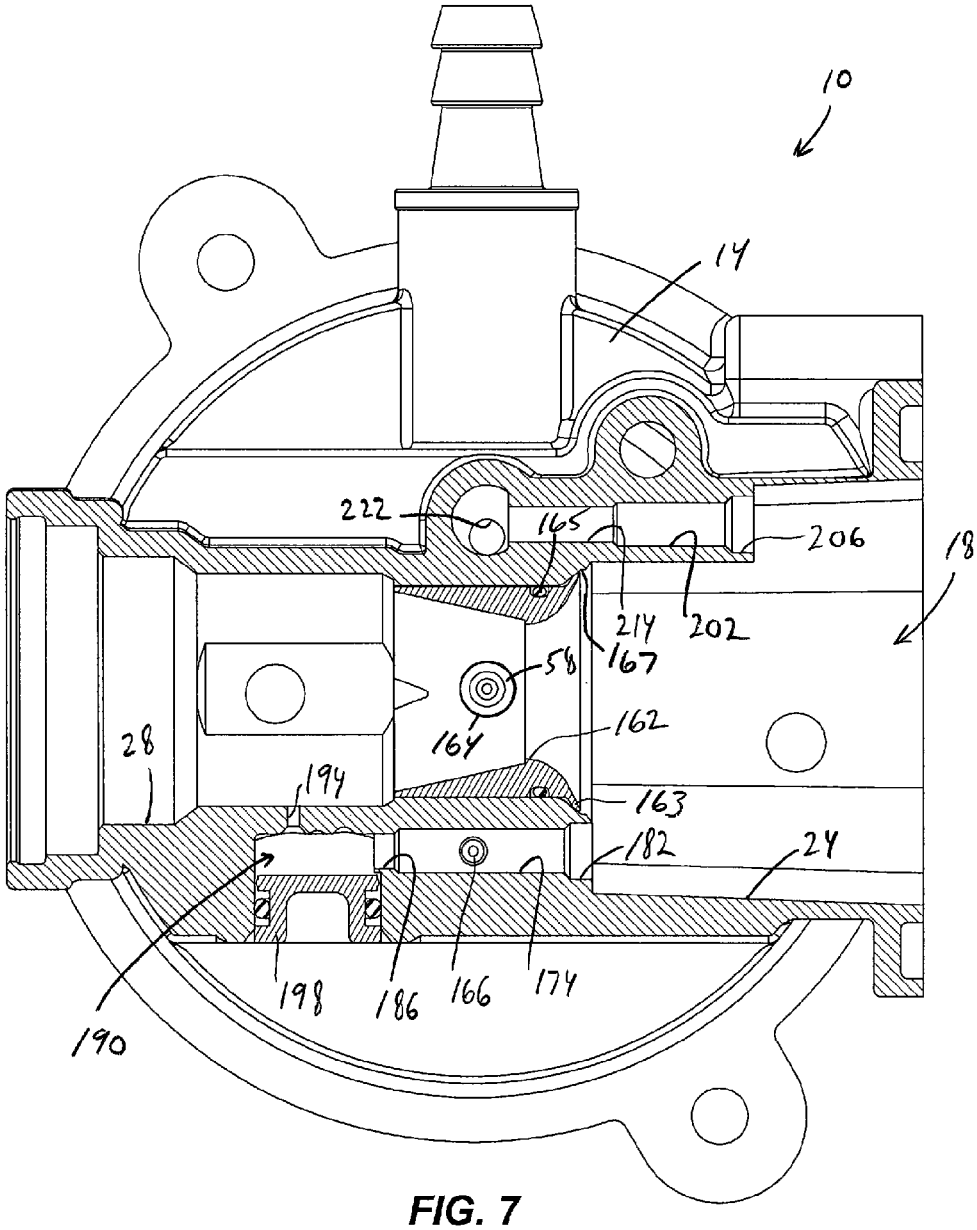
FIG. 7 is a cross-sectional view of the carburetor of FIG. 1 taken along line 7-7 in FIG. 5.

With continued reference to FIG. 10, the carburetor body 14 includes an aperture 154 through which the main circuit conduit 58 extends. As a result, an end 158 of the main circuit passageway 66 opposite the end 122 is disposed in the air/fuel passageway 18 and is in fluid communication with the air/fuel passageway 18. Specifically, the portion of the main circuit conduit 58 protruding into the air/fuel passageway 18 is disposed proximate a venturi 162 in the carburetor 10 (FIG. 7). As a result, the end 158 of the main circuit passageway 66 is disposed in a region of relatively low pressure in the air/fuel passageway 18, thereby allowing fuel to be drawn from the fuel reservoir 110, via the main circuit passageway 66, and into the air/fuel passageway 18 during part-throttle or full-throttle engine operation.

In the illustrated construction of the carburetor 10, the venturi 162 is configured as a separate insert that is disposed in the air/fuel passageway 18. The venturi 162 includes a lip 163 surrounding the inlet of the venturi 162 that is deflectable in response to engaging an adjacent interior wall 167 of the carburetor body 14. The venturi 162 also includes an aperture 164 through which the main circuit conduit 58 extends. During insertion of the insert 42 into the stem 46, the tapered end of the main circuit conduit 58 is received in the aperture 164 to facilitate locating the venturi 162 into its final position in the air/fuel passageway 18. As the venturi 162 is brought into its final position, the lip 163 engages the adjacent interior wall 167 and at least partially deflects, thereby creating an interference fit between the venturi 162 and the adjacent interior wall 167 to seal the venturi 162 against the adjacent interior wall 167. This, in turn, substantially prevents any leakage from occurring between the venturi 162 and the adjacent interior wall 167. Another seal (e.g., an O-ring 165) is disposed about the outer periphery of the venturi 162 and is engaged with the adjacent interior wall to supplement the seal created between the lip 163 and the adjacent interior wall. The central orifice of the venturi 162 may have any of a number of different sizes depending upon the airflow requirements of the engine with which the carburetor 10 is used.

Figure 6:
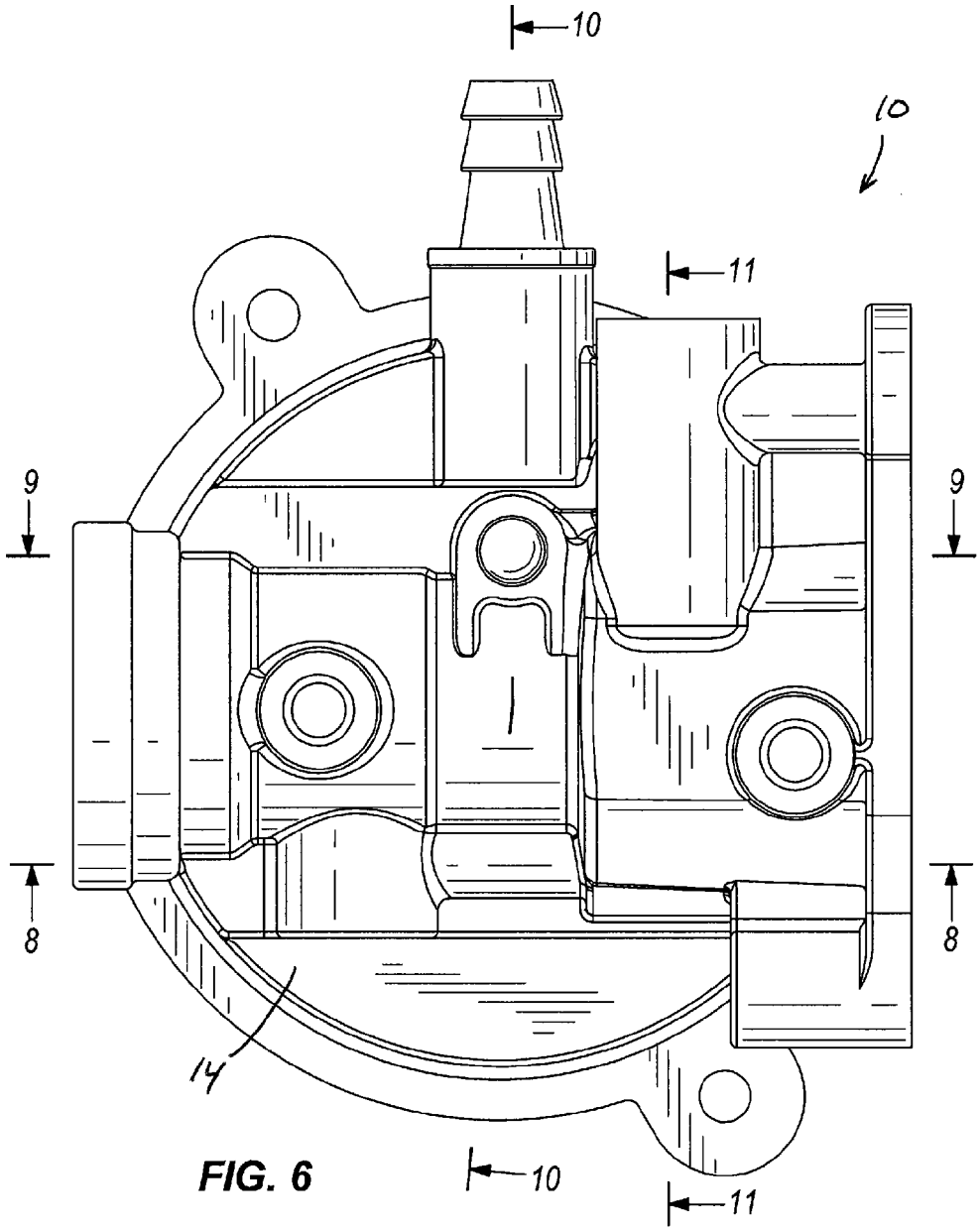
FIG. 6 is an assembled, top view of the carburetor of FIG. 1.

With reference to FIG. 8, the carburetor body 14 includes a fuel passageway 166 defining a longitudinal axis 170, and an idle circuit air bleed passageway 174, defining a longitudinal axis 178 substantially parallel with the direction of the air/fuel passageway 18, in fluid communication with the fuel passageway 18. Specifically, the idle circuit air bleed passageway 174 includes an inlet 182 exposed to the upstream portion 24 of the air/fuel passageway 18, and an outlet 186 exposed to a throttle progression pocket 190 formed in the carburetor body 14 (see also FIG. 7). The fuel passageway 166 is in fluid communication with the idle circuit air bleed passageway 174 at a location between the inlet 182 and the outlet 186 of the idle circuit air bleed passageway 174. The fuel passageway 166 is also in fluid communication with the idle circuit passageway 62 to receive fuel discharged from or exiting the idle circuit passageway 62 during operation of the engine. As is described in more detail below, the fuel passageway 166 introduces fuel into the idle circuit air bleed passageway 174, and the resultant air/fuel mixture is delivered to the throttle progression pocket 190 for use by the engine during idle. In the illustrated construction of the carburetor 10, the respective axes 170, 178 of the fuel passageway 166 and the idle circuit air bleed passageway 174 are oriented substantially normal or orthogonal to each other and are contained within a common plane (e.g., plane 8-8 in FIG. 6). Such an arrangement of the respective passageways 166, 174 facilitates molding the carburetor body 14 as a single piece, with the passageways 166, 174 being formed during the molding process. As such, subsequent machining processes are not required to create either of the respective passageways 166, 174.

With reference to FIGS. 7 and 8, a plurality of apertures 194 fluidly communicate the throttle progression pocket 190 with the downstream portion 28 of the air/fuel passageway 18. As is described in more detail below, the throttle valve 26 progressively uncovers the apertures 194 as the throttle valve 26 opens from its substantially closed position at idle to provide a smooth transition from the engine idling to part-throttle or full-throttle operation of the engine. As shown in FIG. 7, the carburetor 10 includes a plug 198 coupled to the body 14 (e.g., using a press-fit or an interference fit, using adhesives, by welding, etc.). The plug 198 at least partially defines the pocket 190, and substantially prevents air from being drawn into the pocket 190 to dilute the air/fuel mixture in the pocket 190.

Figure 9:
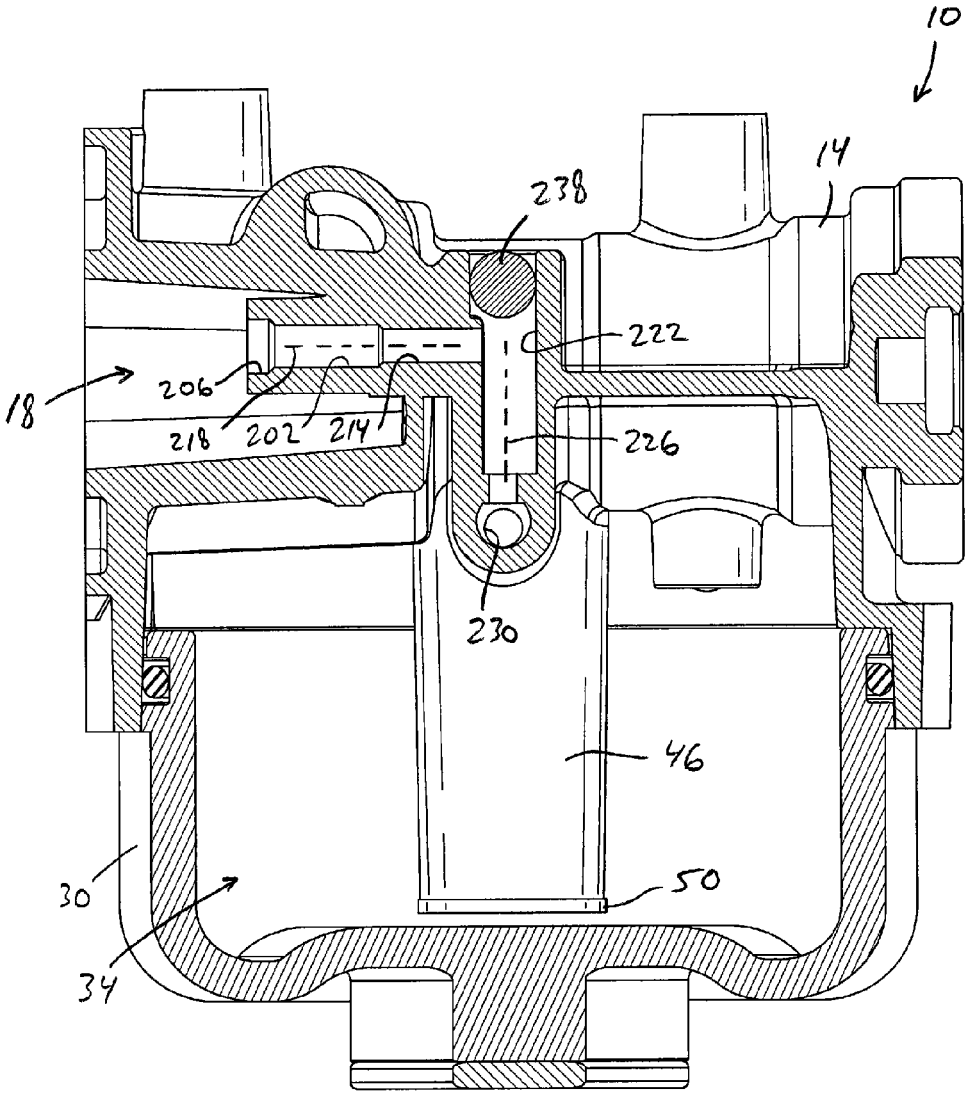
FIG. 9 is a cross-sectional view of the carburetor of FIG. 1 taken along line 9-9 in FIG. 6.

With reference to FIGS. 9 and 10, the carburetor body 14 includes a main circuit air bleed passageway 202 having an inlet 206 (FIG. 9) exposed to the upstream portion 24 of the air/fuel passageway 18, and an outlet 210 (FIG. 10) exposed to the air chamber 90 in the interior of the stem 46. In the illustrated construction of the carburetor 10, the main circuit air bleed passageway 202 includes a first portion 214 having the inlet 206 at one end and defining a longitudinal axis 218 that is oriented horizontally relative to the point of view of FIG. 9. The main circuit air bleed passageway 202 also includes a second portion 222 having the outlet 210 at one end and defining a longitudinal axis 226 that is oriented horizontally relative to the point of view of FIG. 10. The main circuit air bleed passageway 202 further includes an intermediate, third portion 230 defining a longitudinal axis 234 that is oriented substantially vertically relative to the point of view of FIGS. 9 and 10. The third portion 230 of the main circuit air bleed passageway 202 fluidly communicates the first and second portions 214, 222. In the illustrated construction of the carburetor 10, the longitudinal axes 218, 226, 234 of the respective first, second, and third portions 214, 222, 230 of the main circuit air bleed passageway 202 are oriented mutually orthogonal to each other to facilitate molding the carburetor body 14 as a single piece, with the passageway 202 being formed during the molding process. As such, subsequent machining processes are not required to create any of the respective portions 214, 222, 230 of the passageway 202.

With reference to FIG. 10, a first plug 238 is at least partially positioned within the second portion 222 of the main circuit air bleed passageway 202 at a location disposed from the outlet 210, and a second plug 242 is at least partially positioned within the third portion 230 of the main circuit air bleed passageway 202 at a location disposed from an end of the third portion 230 exposed to the second portion 222 of the main circuit air bleed passageway 202. The respective plugs 238, 242 direct the flow of air from the inlet 206 to the outlet 210, and substantially prevent leakage of air into the main circuit air bleed passageway 202 between the inlet 206 and the outlet 210. In the illustrated construction of the carburetor 10, each of the plugs 238, 242 is configured as a ball bearing that is press-fit or interference fit to the carburetor body 14. Alternatively, the plugs 238, 242 may be differently configured, and the plugs 238, 242 may be secured to the carburetor body 14 in any of a number of different ways (e.g., by using adhesives, by welding, etc.).

Figure 11:
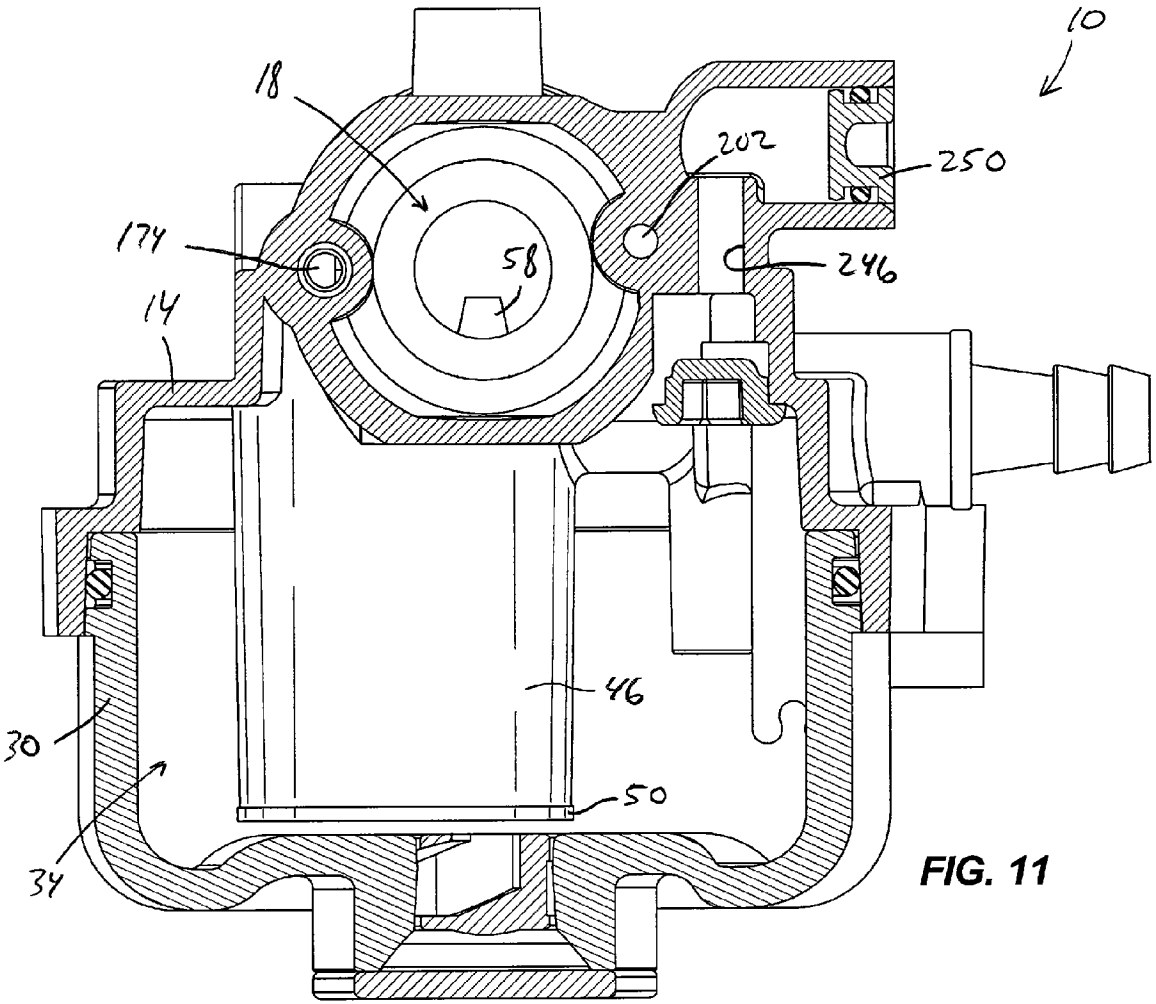
FIG. 11 is a cross-sectional view of the carburetor of FIG. 1 taken along line 11-11 in FIG. 6.

With reference to FIGS. 1 and 11, the carburetor body 14 also includes a priming passageway 246 in fluid communication with the fuel bowl chamber 34. The priming passageway 246 includes an inlet 248 (see FIG. 1) positioned in a flange of the body 14 configured for mounting to an air cleaner assembly (not shown) of the engine incorporating the carburetor 10. The air cleaner assembly may include a primer bulb and another priming passageway, in which the primer bulb is at least partially disposed, in fluid communication with the inlet 248 of the priming passageway 246. With reference to FIG.

11, the carburetor 10 includes a plug 250 positioned in the priming passageway 246. Although not shown, the plug 250 may include a small aperture or orifice to provide external venting of the fuel bowl chamber 34. The small aperture or orifice in the plug 250 may also be sized to tune the amount of primer charge that results when an operator of the engine depresses the primer bulb in the air cleaner assembly to prime the carburetor 10 prior to starting the engine. Specifically, an operator may depress the primer bulb to displace the air in the priming passageway 246 down into the fuel bowl chamber 34, thereby displacing a substantially equivalent volume of fuel through the insert 42 (e.g., via the main circuit passageway 66) and into the air/fuel passageway 18 to enrichen the air/fuel mixture delivered to the engine during startup.

In operation of the carburetor 10 during engine idling, the region of relatively low pressure downstream of the throttle valve 26, when oriented in a substantially closed position, creates an airflow through the idle circuit air bleed passageway 174 which, in turn, draws fuel from the fuel bowl chamber 34, through the orifice 114 in the jet 106, and into the fuel reservoir 110 (FIG. 10). Fuel is subsequently drawn from the fuel reservoir 110, through the idle circuit passageway 62, through the orifice 134 in the jet 126, through the fuel passageway 166 in the carburetor body 14, and into the idle circuit air bleed passageway 174, where the fuel mixes with the air in the passageway 174. With reference to FIG. 8, the air/fuel mixture in the idle circuit air bleed passageway 174 then moves into the throttle progression pocket 190, where the air/fuel mixture may be drawn through one of the apertures 194 and into the air/fuel passageway 18 to maintain idling the engine. As the throttle valve 26 opens from its substantially closed position, more of the apertures 194 are uncovered to draw a progressively increasing amount of air/fuel mixture from the pocket 190, thereby providing a smooth transition to part-throttle or full-throttle engine operation.

During part-throttle or full-throttle engine operation, the region of relatively low pressure surrounding the portion of the main circuit conduit 58 protruding into the air/fuel passageway 18 creates an airflow through the main circuit air bleed passageway 202 and draws fuel from the fuel bowl chamber 34, through the orifice 114 in the jet 106, and into the fuel reservoir 110 (FIG. 10). Fuel is subsequently drawn from the fuel reservoir 110 and through the main circuit passageway 66, which causes air in the air chamber 90 to be drawn through the apertures 98 and into the main circuit passageway 66 to mix with the fuel in the main circuit passageway 66. The resultant air/fuel mixture in the main circuit passageway 66 is discharged directly into the air/fuel passageway 18 for use by the engine during part-throttle or full-throttle operation.

Figure 12:
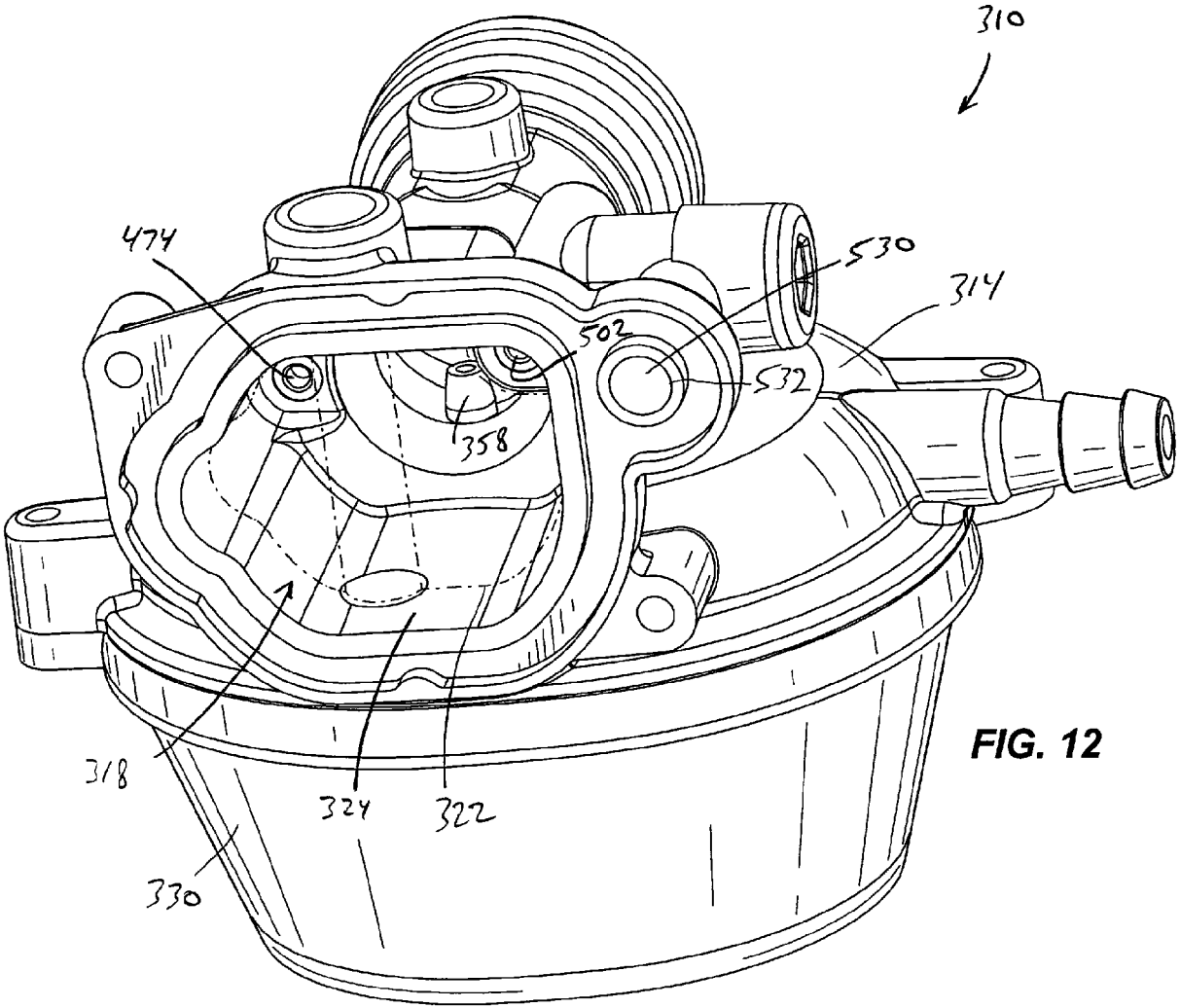
FIG. 12 is a perspective view of a first end of a second construction of a carburetor according to the invention, illustrating an air/fuel passageway and a choke valve in the air/fuel passageway.
Figure 13:
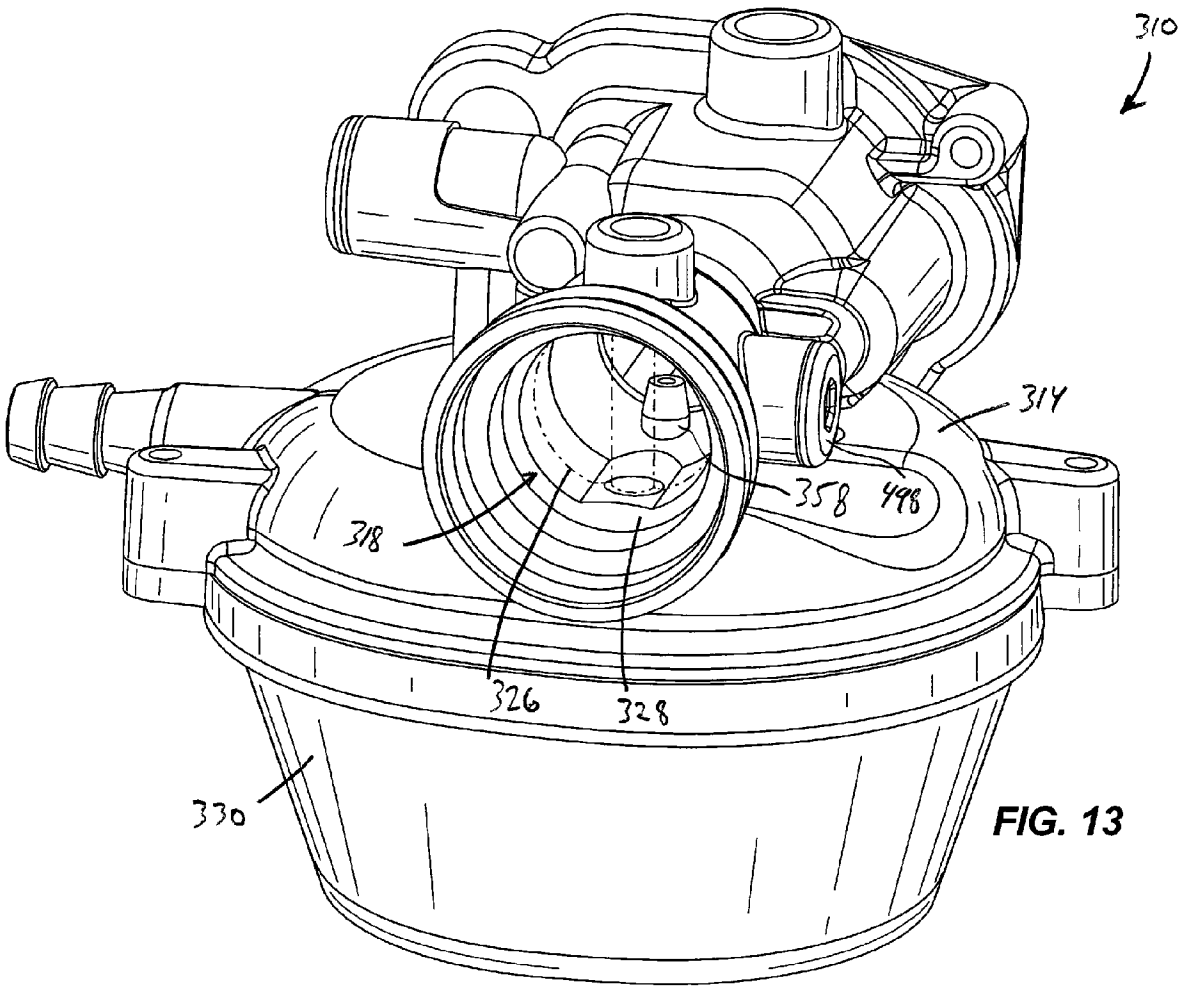
FIG. 13 is a perspective view of a second end of the carburetor of FIG. 12, illustrating a throttle valve in the air/fuel passageway.

FIGS. 12 and 13 illustrate a second construction of a carburetor 310 configured for use with a small internal combustion engine. The carburetor 310 includes a body 314 defining an air/fuel passageway 318 in which a mixture of fuel and air is created for consumption by the engine. The body 314 is made of a single piece of plastic material using a molding process, with the exception of a few fittings or plugs coupled to the body 314 after it is molded. Alternatively, the body 314 may be made from metal as a single piece using a casting process. The carburetor 310 includes a choke valve 322 positioned in an upstream portion 324 of the passageway 318 (FIG. 12), and a throttle valve 326 (FIG. 13) positioned in a downstream portion 328 of the passageway 318. Movement of the choke valve 322 and throttle valve 326 may be controlled in a conventional manner using mechanical linkages (e.g., shafts, arms, cables, etc.). Alternatively, the choke valve 322 may be omitted.

Figure 14:
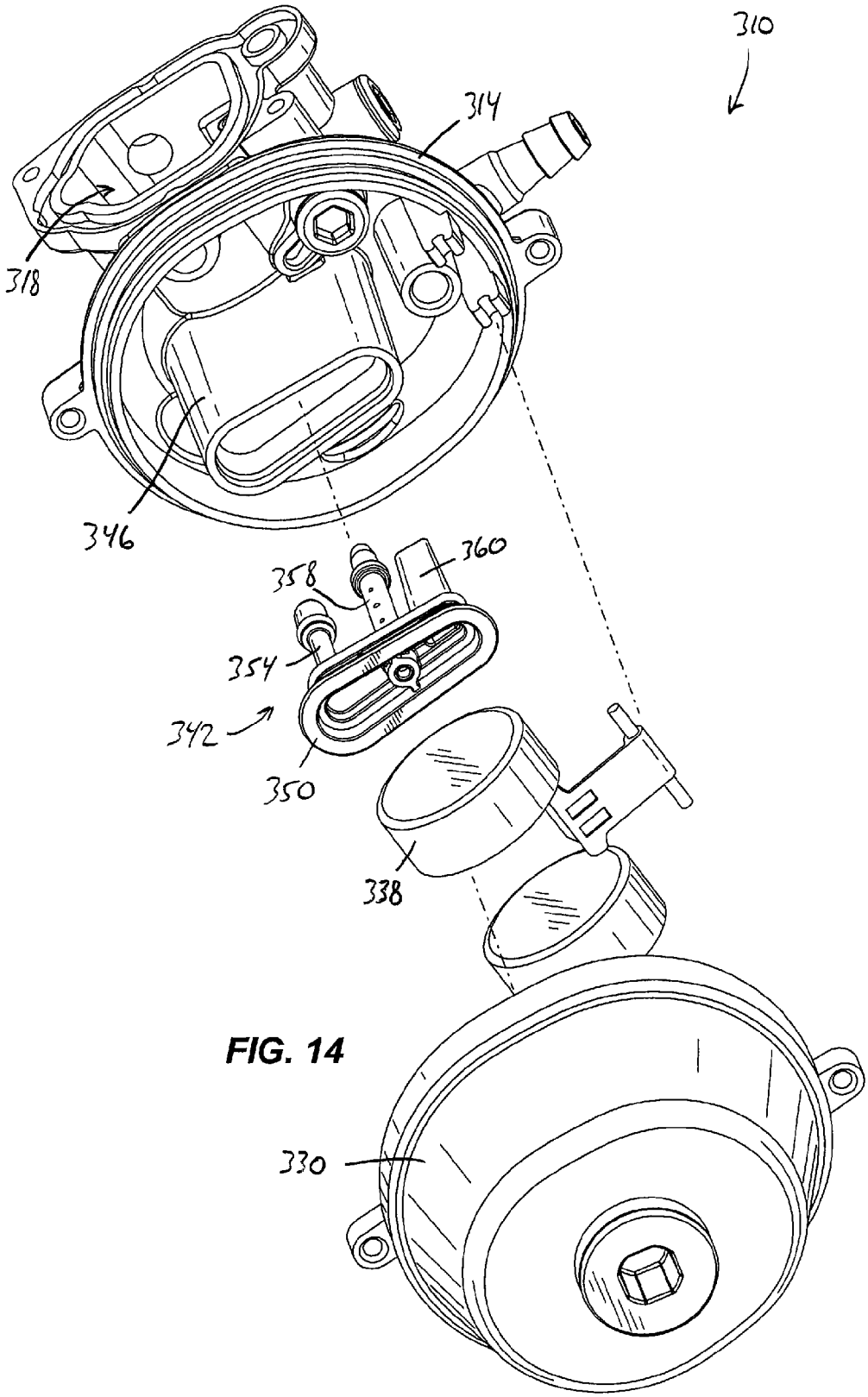
FIG. 14 is an exploded, bottom perspective view of the carburetor of FIG. 12, illustrating a one-piece fuel-metering insert.
Figure 16:
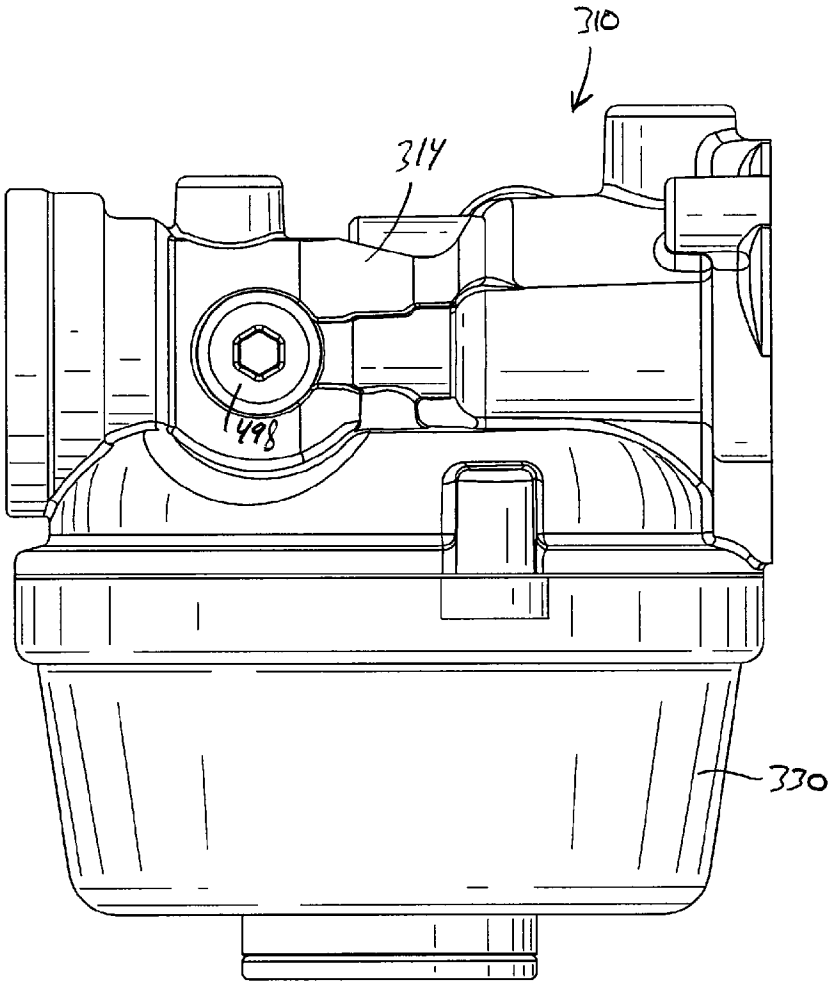
FIG. 16 is an assembled, side view of the carburetor of FIG. 12.
Figure 19:
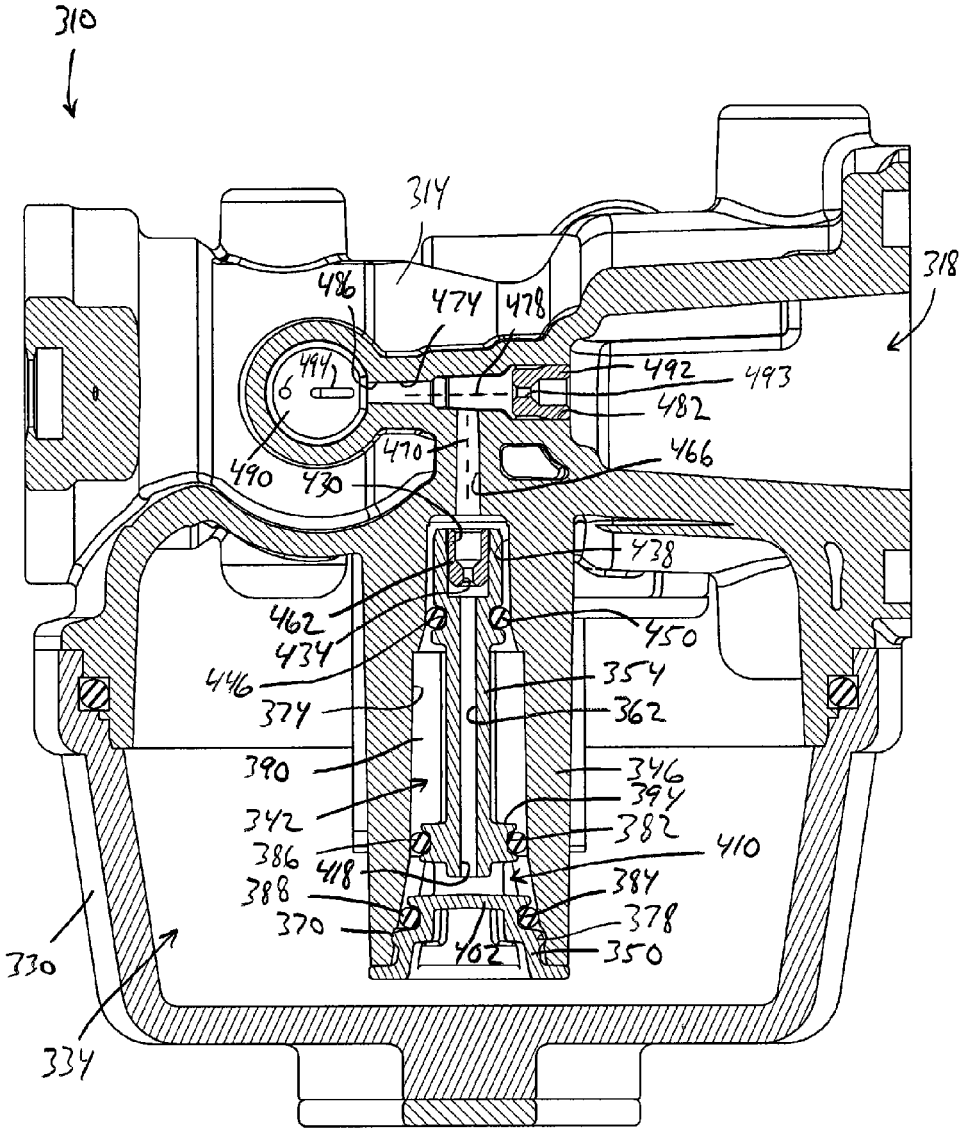
FIG. 19 is a cross-sectional view of the carburetor of FIG. 12 taken along line 19-19 in FIG. 17.

With reference to FIG. 14, the carburetor 310 also includes a fuel bowl 330 coupled to the body 314. The body 314 and the fuel bowl 330 define a fuel bowl chamber 334 in which fuel is stored (FIG. 19). The carburetor 310 also includes a float 338 pivotably coupled to the body 314 (FIG. 14). The float 338 is operable in a conventional manner in conjunction with a valve (not shown) to meter the amount of fuel introduced into the fuel bowl chamber 334. Alternatively, the carburetor 310 may include different structure, besides the float 338, with which to meter the amount of fuel introduced into the fuel bowl chamber 334.

Figure 15:
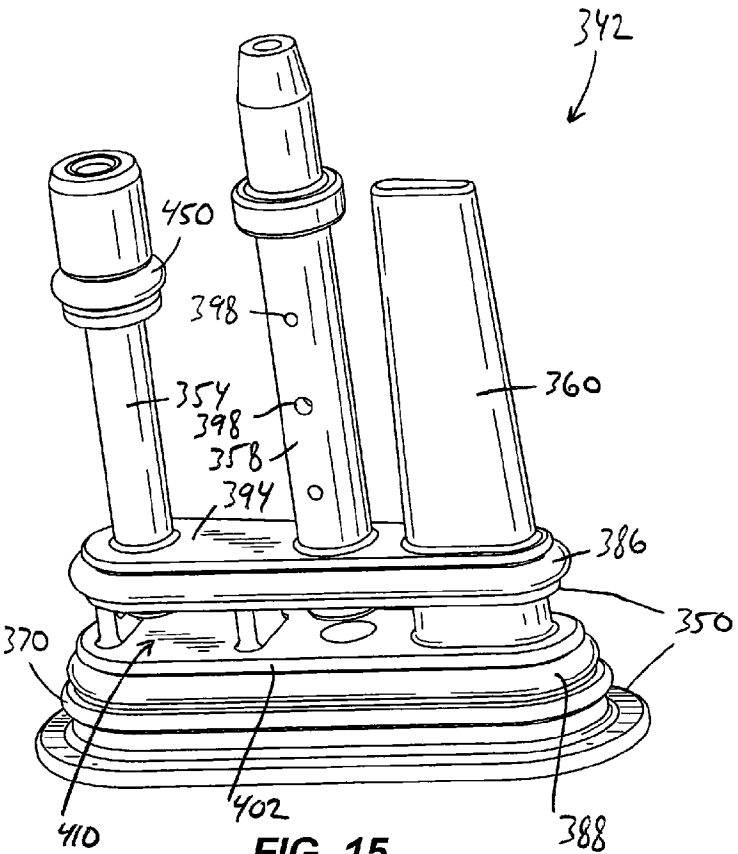
FIG. 15 is a front perspective view of the fuel-metering insert of FIG. 14.
Figure 21:
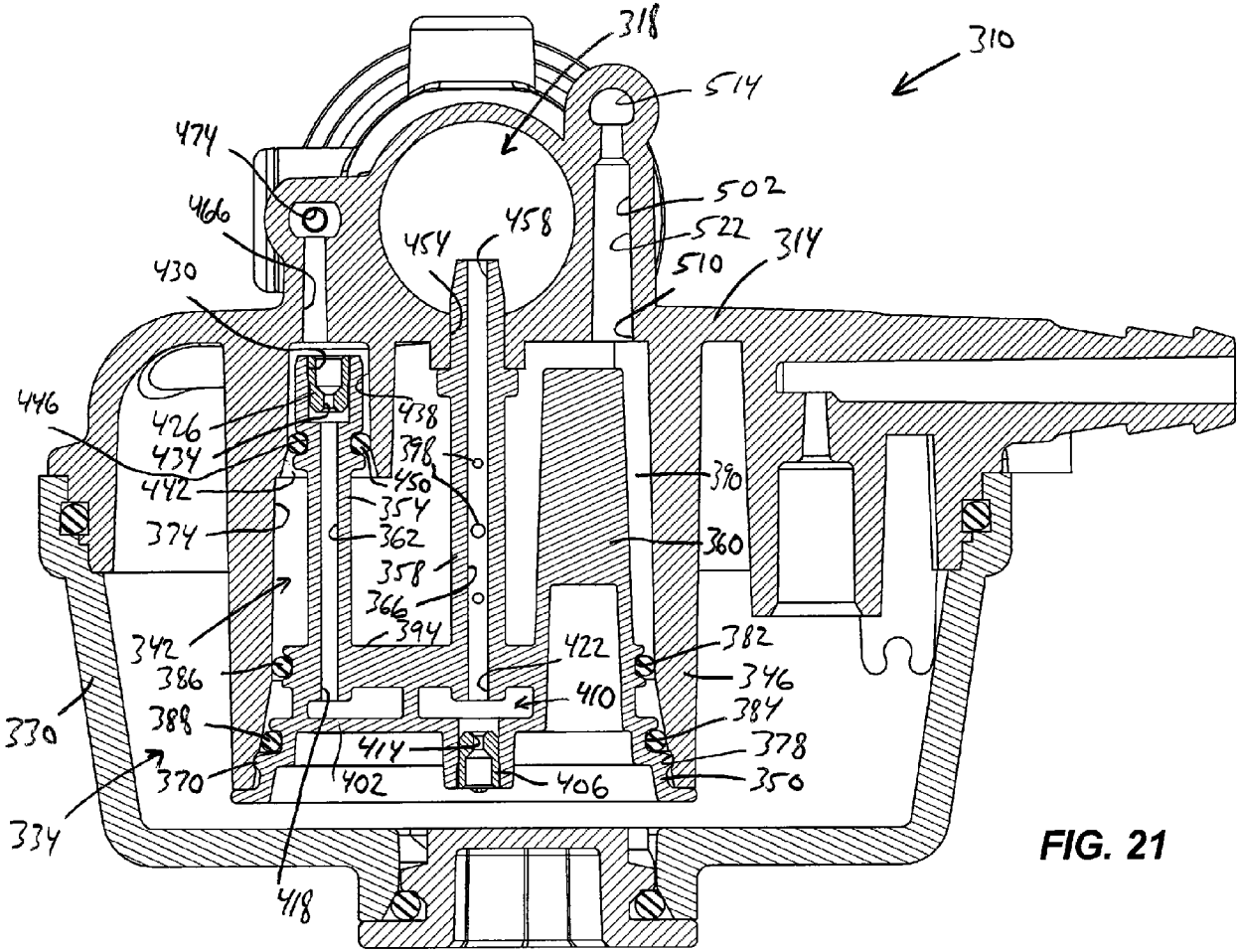
FIG. 21 is a cross-sectional view of the carburetor of FIG. 12 taken along line 21-21 in FIG. 17.

With reference to FIGS. 14 and 15, the carburetor 310 also includes a fuel-metering insert 342 coupled to a stem 346 on the body 314. As shown in FIG. 15, the insert 342 includes a base 350, an idle circuit conduit 354 extending from the base 350, a main circuit conduit 358 extending from the base 350, and a projection 360 extending from the base 350, the purpose of which is described in more detail below. In the illustrated construction of the carburetor 310, the insert 342 is formed as a single piece of plastic material using a molding process. Alternatively, the insert 342 may be made from metal as a single piece using a casting process. With reference to FIG. 21, the idle circuit conduit 354 defines therein an idle circuit passageway 362 through which fuel flows from the fuel bowl chamber 334 to the air/fuel passageway 318 when the throttle valve 326 is oriented in a substantially closed position corresponding with an idle speed of the associated engine. The main circuit conduit 358 defines therein a main circuit passageway 366 through which fuel flows from the fuel bowl chamber 334 to the air/fuel passageway 318 when the throttle valve 326 is opened from its substantially closed position when the associated engine is operating at part throttle or full throttle. In other words, when the engine is operating at part throttle or full throttle, fuel is drawn into the air/fuel passageway 318 via the main circuit passageway 366.

With continued reference to FIG. 21, the stem 346 extends into the fuel bowl chamber 334, and the insert 342 is supported within the interior of the stem 346. In the illustrated construction of the carburetor 310, the insert 342 is coupled and secured to the stem 346 using a snap-fit. Specifically, the insert 342 includes a lip 370 formed around the outer periphery of the base 350, and the stem 346 includes an interior wall 374 defining therein a groove 378 in which the lip 370 is received. As such, the insertion of the lip 370 into the groove 378 provides an indication (e.g., with an audible click) during assembly that the insert 342 is fully inserted within the stem 346. The configuration of the lip 370 and the groove 378 also substantially prevents unintentional removal of the insert 342 from the stem 346. Alternatively, the stem 346 and the insert 342 may utilize any of a number of different structural features or components with which to couple and secure the insert 342 to the stem 346. As a further alternative, any of a number of different processes may be employed to couple and secure the insert 342 to the stem 346 (e.g., using an interference fit, using adhesives, welding, etc.).

With continued reference to FIG. 21, the base 350 of the insert 342 includes spaced grooves 382, 384 in which respective seals 386, 388 (e.g., O-rings) are positioned. Each of the seals 386, 388 is engaged with the interior wall 374 of the stem 346 about the inner periphery of the stem 346 to substantially prevent fuel from leaking between the insert 342 and the interior wall 374 of the stem 386. Consequently, the stem 346 and the insert 342 at least partially define an air chamber 390, located above the insert 342, within the interior of the stem 346. Specifically, the lower extent of the air chamber 390 is defined by an upper wall 394 of the base 350 which the idle circuit conduit 354 and the main circuit conduit 358 extend. The main circuit conduit 358 includes a plurality of apertures 398 fluidly communicating the main circuit passageway 366 and the air chamber 390, the function of which is described in more detail below.

With continued reference to FIG. 21, the insert 342 includes a lower wall 402 spaced from the upper wall 394, and a jet 406 supported by the lower wall 402. The walls 394, 402 define therebetween a fuel reservoir 410, and the jet 406 includes an orifice 414 sized to meter fuel flow from the fuel bowl chamber 334 to the fuel reservoir 410. In the illustrated construction of the carburetor 310, the jet 406 is configured as a separate and distinct component from the insert 342 that is coupled to the insert 342 (e.g., using a press-fit or an interference fit, using adhesives, by welding, etc.). Alternatively, the jet 406 may be omitted, and the lower wall 402 may include an orifice substantially identical to the orifice 414 in the jet 406 to meter fuel flow from the fuel bowl chamber 334 to the fuel reservoir 410.

Respective ends 418, 422 of the idle circuit passageway 362 and the main circuit passageway 366 are in fluid communication with the fuel reservoir 410 to draw fuel directly from the fuel reservoir 410 during operation of the engine incorporating the carburetor 310. Another jet 426 is coupled to the idle circuit conduit 354 at a location proximate an end 430 of the idle circuit passageway 362 opposite the end 418. The jet 426 includes an orifice 434 sized to meter fuel flow that is discharged from or exiting the idle circuit passageway 362. In the illustrated construction of the carburetor 310, the jet 426 is configured as a separate and distinct component from the insert 342 and is coupled to the insert 342 (e.g., using a press-fit or an interference fit, using adhesives, by welding, etc.). Alternatively, the jet 426 may be omitted, and the end 430 of the idle circuit passageway 362 may be formed to include an orifice substantially identical to the orifice 434 in the jet 426 to meter fuel flow exiting the idle circuit passageway 362.

With continued reference to FIG. 21, the carburetor body 314 includes a receptacle 438 within the stem 346 into which the idle circuit conduit 354 is at least partially received. In the illustrated construction of the carburetor 310, the receptacle 438 is at least partially defined by the interior wall 374 of the stem 346 and an arcuate wall 442 extending from the carburetor body 314 toward the fuel bowl 330. Alternatively, the receptacle 438 may be defined by different structure of the carburetor body 314. The idle circuit conduit 354 includes a groove 446 in which a seal 450 (e.g., an O-ring) is positioned. A portion of the seal 450 is engaged with the interior wall 374 of the stem 346, and the remaining portion of the seal 450 is engaged with the arcuate wall 442 to substantially prevent any leakage of air from the air chamber 390 into the space above the seal 450.

Figure 18:
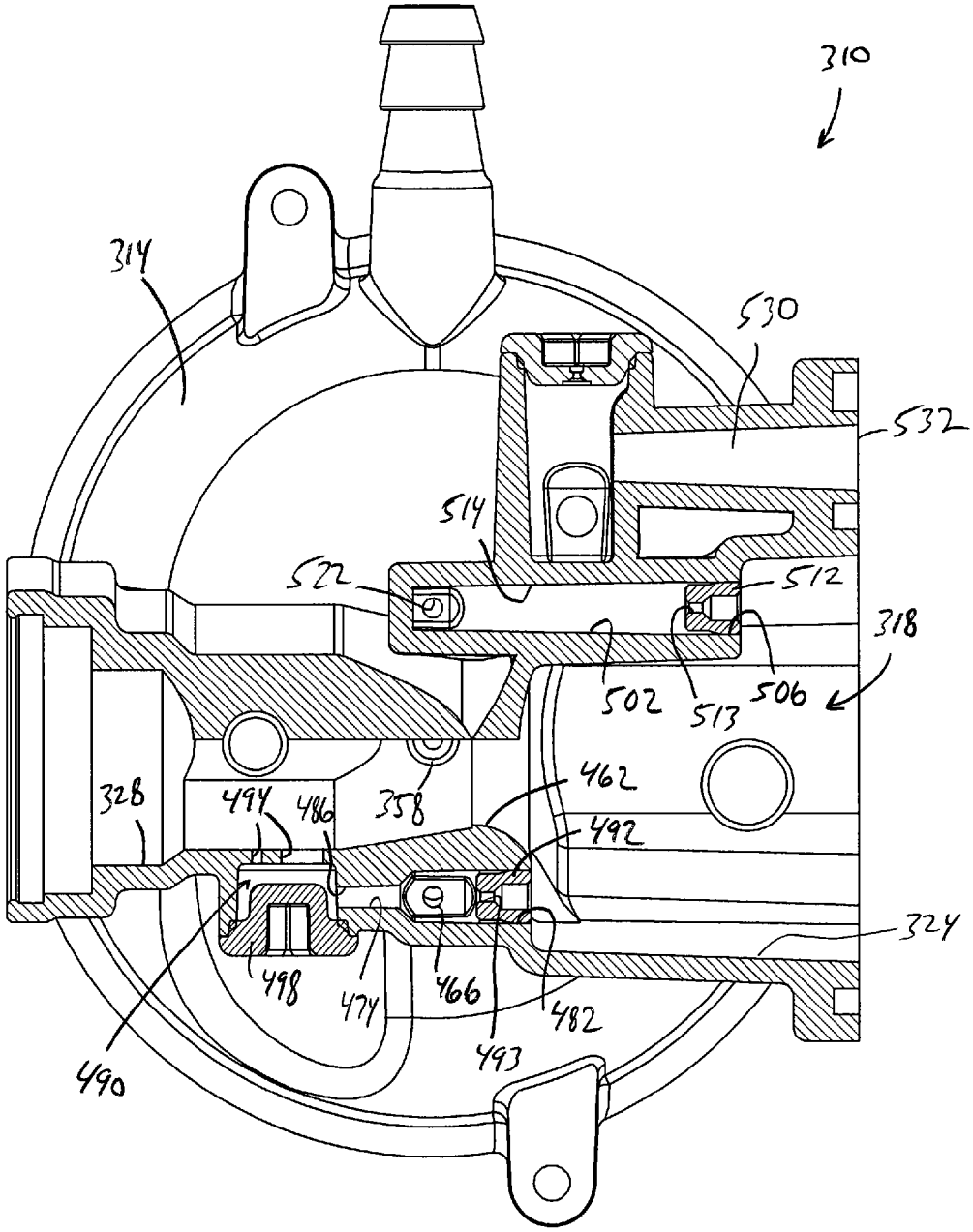
FIG. 18 is a cross-sectional view of the carburetor of FIG. 12 taken along line 18-18 in FIG. 22.

With continued reference to FIG. 21, the carburetor body 314 includes an aperture 454 through which the main circuit conduit 358 extends. As a result, an end 458 of the main circuit passageway 366 opposite the end 422 is disposed in the air/fuel passageway 318 and is in fluid communication with the air/fuel passageway 18. Specifically, the portion of the main circuit conduit 358 protruding into the air/fuel passageway 318 is disposed proximate a venturi 462 in the carburetor 310 (FIG. 18). As a result, the end 458 of the main circuit passageway 366 is disposed in a region of relatively low pressure in the air/fuel passageway 318, thereby allowing fuel to be drawn from the fuel reservoir 410, via the main circuit passageway 366, and into the air/fuel passageway 318 during part-throttle or full-throttle engine operation. Although the venturi 462 is integral with the carburetor body 314 as shown in FIG. 18, the venturi 462 may alternatively be configured as a separate insert like the venturi 162 shown in FIG. 7.

With reference to FIG. 19, the carburetor body 314 includes a fuel passageway 466 defining a longitudinal axis 470, and an idle circuit air bleed passageway 474, defining a longitudinal axis 478 substantially parallel with the direction of the air/fuel passageway 318, in fluid communication with the fuel passageway 466. Specifically, the idle circuit air bleed passageway 474 includes an inlet 482 exposed to the upstream portion 324 of the air/fuel passageway 318, and an outlet 486 exposed to a throttle progression pocket 490 formed in the carburetor body 314 (see also FIG. 18). As shown in FIGS. 18 and 19, a jet 492 is coupled to the carburetor body 314 in the inlet 482 of the idle circuit air bleed passageway 474. The jet 492 includes an orifice 493 sized to meter the airflow drawn into the idle circuit air bleed passageway 474. In the illustrated construction of the carburetor 310, the jet 492 is configured as a separate and distinct component from the carburetor body 314 that is coupled to the carburetor body 314 (e.g., using a press-fit or an interference fit, using adhesives, by welding, etc.). Alternatively, the jet 492 may be omitted, and the inlet 482 of the idle circuit air bleed passageway 474 may be formed to include an orifice substantially identical to the orifice 492 in the jet 492 to meter the airflow drawn into the idle circuit air bleed passageway 474.

Figure 17:
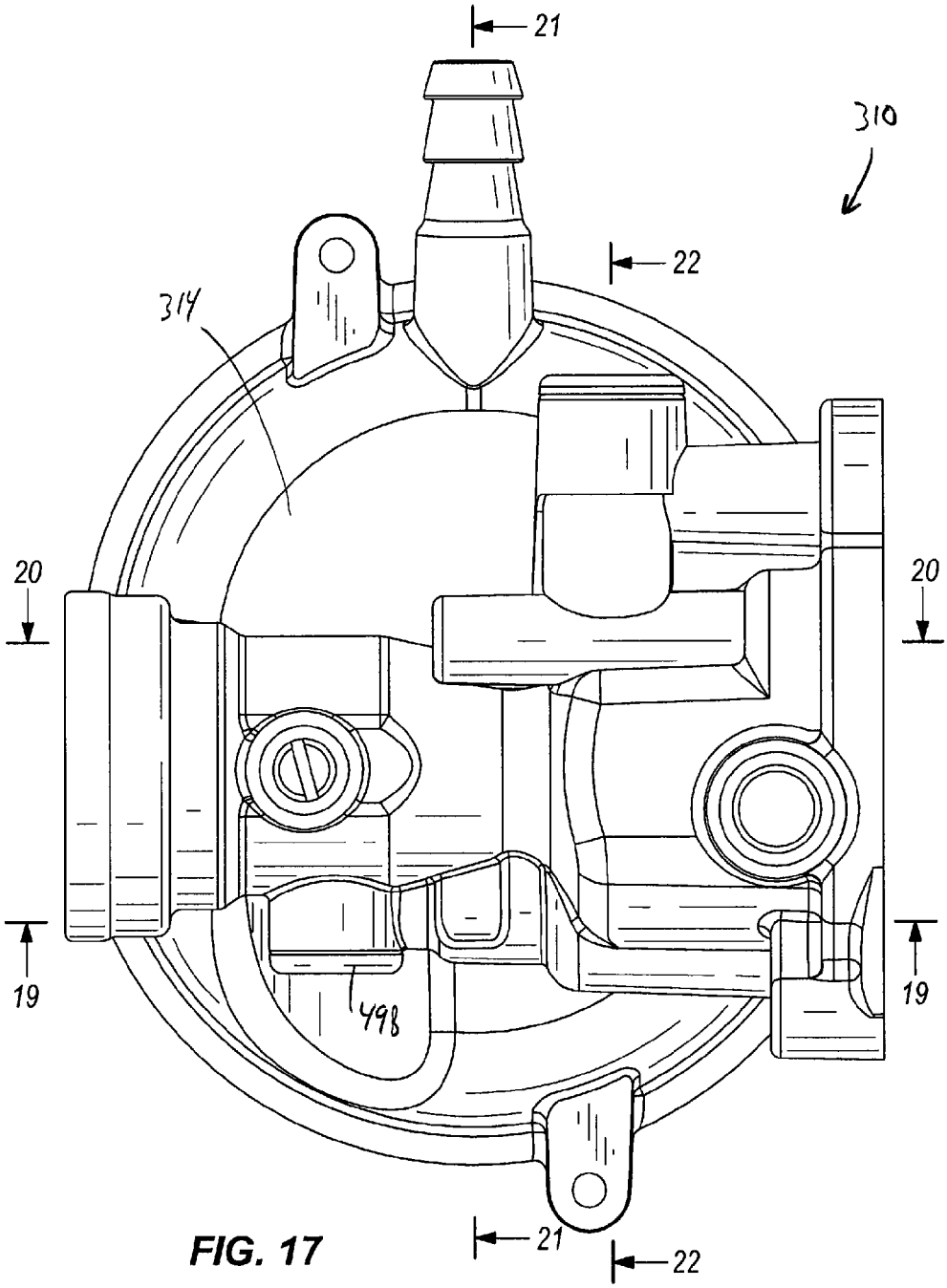
FIG. 17 is an assembled, top view of the carburetor of FIG. 12.

With reference to FIG. 19, the fuel passageway 466 is in fluid communication with the idle circuit air bleed passageway 474 at a location between the inlet 482 and the outlet 486 of the idle circuit air bleed passageway 474. The fuel passageway 466 is also in fluid communication with the idle circuit passageway 362 to receive fuel discharged from or exiting the idle circuit passageway 362 during operation of the engine. As such, as is described in more detail below, the fuel passageway 466 introduces fuel into the idle circuit air bleed passageway 474, and the resultant air/fuel mixture is delivered to the throttle progression pocket 490 for use by the engine during idle. In the illustrated construction of the carburetor 310, the respective axes 470, 478 of the fuel passageway 466 and the idle circuit air bleed passageway 474 are oriented substantially normal or orthogonal to each other and are contained within a common plane (e.g., plane 19-19 in FIG. 17). Such an arrangement of the respective passageways 466, 474 facilitates molding the carburetor body 314 as a single piece, with the passageways 466, 474 being formed during the molding process. As such, subsequent machining processes are not required to create either of the respective passageways 466, 474.

With reference to FIGS. 18 and 19, a plurality of apertures 494 fluidly communicate the throttle progression pocket 490 with the downstream portion 328 of the air/fuel passageway 318. As is described in more detail below, the throttle valve 326 progressively uncovers the apertures 494 as the throttle valve 326 opens from its substantially closed position at idle to provide a smooth transition from the idling to part-throttle or full-throttle operation of the engine. As shown in FIG. 18, the carburetor 310 includes a plug 498 coupled to the body 314 (e.g., using a press-fit or an interference fit, using adhesives, by welding, etc.). The plug 498 at least partially defines the pocket 490, and substantially prevents air from being drawn into the pocket 490 to dilute the air/fuel mixture in the pocket 490.

Figure 20:
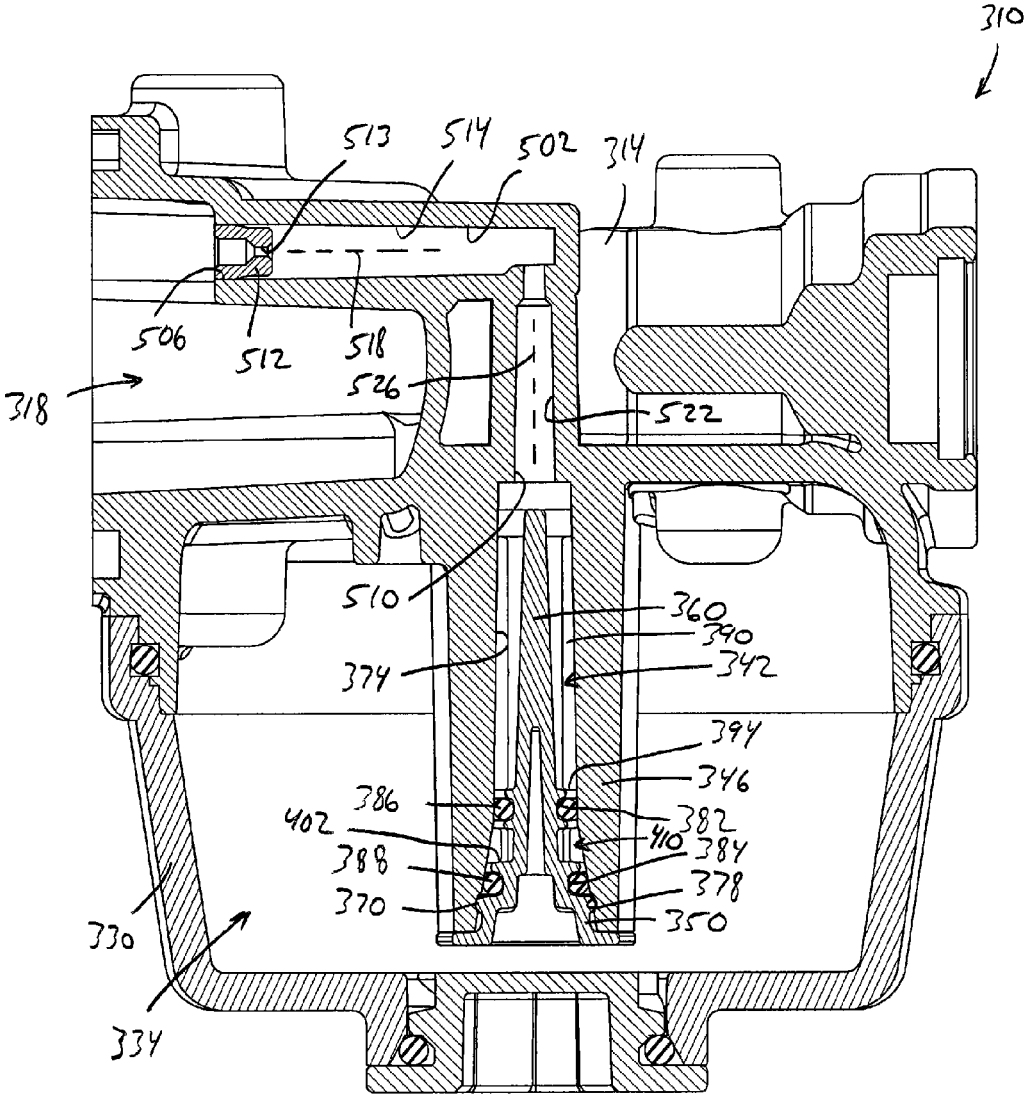
FIG. 20 is a cross-sectional view of the carburetor of FIG. 12 taken along line 20-20 in FIG. 17.

With reference to FIG. 20, the carburetor body 310 includes a main circuit air bleed passageway 502 having an inlet 506 exposed to the upstream portion 324 of the air/fuel passageway 318, and an outlet 510 exposed to the air chamber 390 in the interior of the stem 346 (see also FIG. 21). As shown in FIG. 18, a jet 512 is coupled to the carburetor body 314 in the inlet 506 of the main circuit air bleed passageway 502. The jet 512 includes an orifice 513 sized to meter the airflow drawn into the main circuit air bleed passageway 502. In the illustrated construction of the carburetor 310, the jet 512 is configured as a separate and distinct component form the carburetor body 314 that is coupled to the carburetor body 314 (e.g., using a press-fit or an interference fit, using adhesives, by welding, etc.). Alternatively, the jet 512 may be omitted, and the inlet 506 of the main circuit air bleed passageway may be formed to include an orifice substantially identical to the orifice 513 in the jet 512 to meter the airflow drawn into the main circuit air bleed passageway 502.

In the illustrated construction of the carburetor 310, the main circuit air bleed passageway 502 includes a first portion 514 having the inlet 506 at one end and defining a longitudinal axis 518 that is oriented horizontally relative to the point of view of FIG. 10. The main circuit air bleed passageway 502 also includes a second portion 522 having the outlet 486 at one end and defining a longitudinal axis 526 that is oriented vertically relative to the point of view of FIG. 20. In the illustrated construction of the carburetor 310, the longitudinal axes 518, 526 of the respective first and second portions 514, 522 of the main circuit air bleed passageway 502 are oriented normal or orthogonal to each other to facilitate molding the carburetor body 314 as a single piece, with the passageway 502 being formed during the molding process. As such, subsequent machining processes are not required to create either of the portions 514, 522 of the passageway 502.

Figure 22:
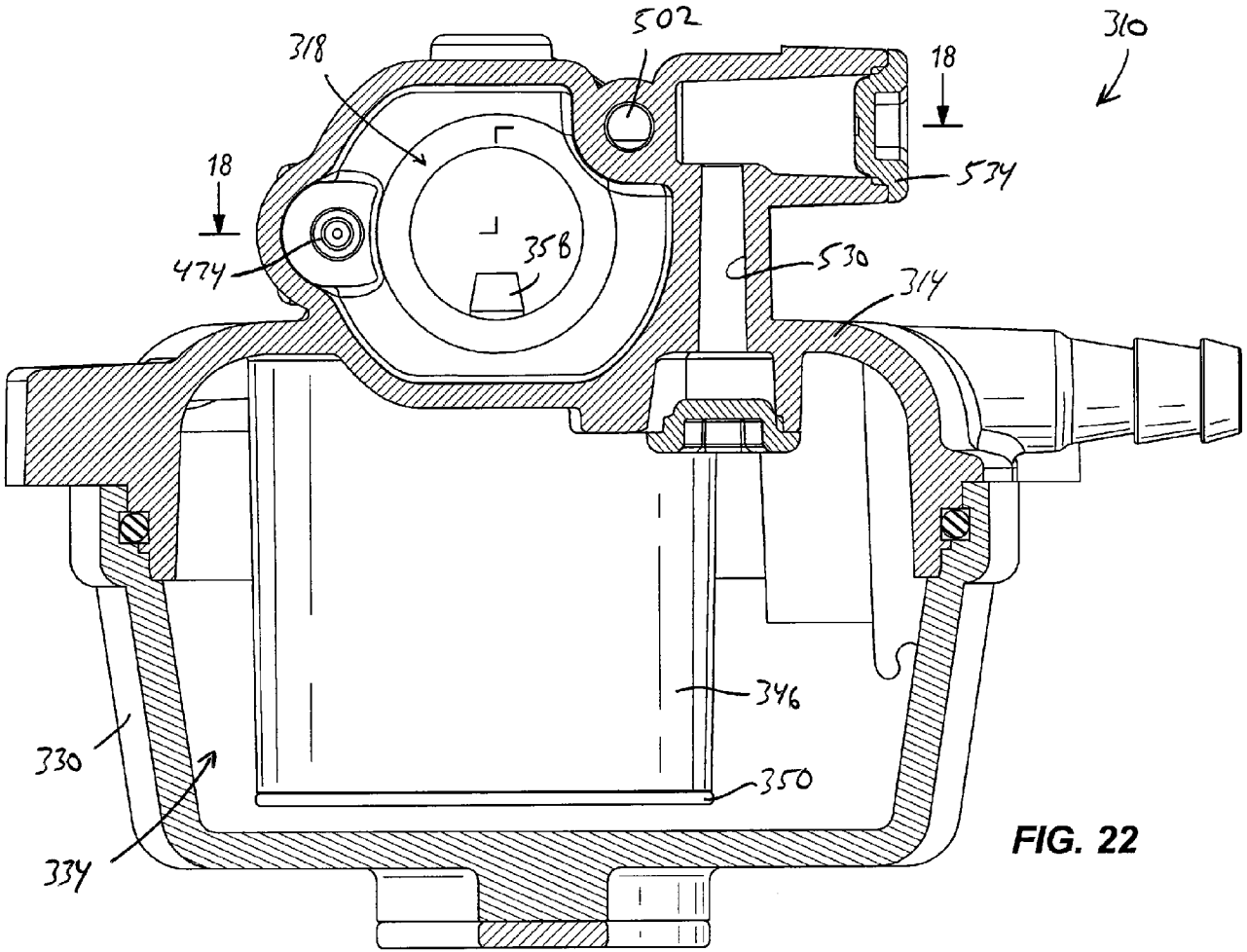
FIG. 22 is a cross-sectional view of the carburetor of FIG. 12 taken along line 22-22 in FIG. 17.

With reference to FIG. 22, the carburetor body 314 also includes a priming passageway 530 in fluid communication with the fuel bowl chamber 334. The priming passageway 530 includes an inlet 532 (see FIGS. 12 and 18) positioned in a flange of the body 314 configured for mounting to an air cleaner assembly (not shown) of the engine incorporating the carburetor 310. The air cleaner assembly may include a primer bulb and another priming passageway, in which the primer bulb is at least partially disposed, in fluid communication with the inlet 532 of the priming passageway 530. With reference to FIG. 11, carburetor 310 includes a plug 534 positioned in the priming passageway 530. Although not shown, the plug 534 may include a small aperture or orifice to provide external venting of the fuel bowl chamber 334. The small aperture or orifice in the plug 534 may also be sized to tune the amount of primer charge that results when an operator of the engine depresses the primer bulb in the air cleaner assembly to prime the carburetor 310 prior to starting the engine. Specifically, an operator may depress the primer bulb to displace the air in the priming passageway 530 down into the fuel bowl chamber 534, thereby displacing a substantially equivalent volume of fuel through the insert 342 (e.g., via the main circuit passageway 362) and into the air/fuel passageway 318 to enrichen the air/fuel mixture delivered to the engine during startup.

In operation of the carburetor 310 during engine idling, the region of relatively low pressure downstream of the throttle valve 326, when oriented in a substantially closed position, creates an airflow through the idle circuit air bleed passageway 474 which, in turn, draws fuel from the fuel bowl chamber 334, through the orifice 414 in the jet 406, and into the fuel reservoir (FIG. 19). Fuel is subsequently drawn from the fuel reservoir 410, through the idle circuit passageway 362, through the orifice 434 in the jet 426, through the fuel passageway 466 in the carburetor body 314, and into the idle circuit air bleed passageway 474, where the fuel mixes with the air in the passageway 474. The air/fuel mixture in the idle circuit air bleed passageway 474 then moves into the throttle progression pocket 490, where the air/fuel mixture may be drawn through one of the apertures 494 and into the air/fuel passageway 318 to maintain the engine idling. As the throttle valve 326 opens from its substantially closed position, more of the apertures 494 are uncovered to draw a progressively increasing amount of air/fuel mixture from the pocket 490, thereby providing a smooth transition to part-throttle or full-throttle engine operation.

During part-throttle or full-throttle engine operation, the region of relatively low pressure surrounding the portion of the main circuit conduit 358 protruding into the air/fuel passageway 318 creates an airflow through the main circuit air bleed passageway 502 and draws fuel from the fuel bowl chamber 334, through the orifice 414 in the jet 406, and into the fuel reservoir 410 (FIG. 21). Fuel is subsequently drawn from the fuel reservoir 410 and through the main circuit passageway 366, which causes air in the air chamber 390 to be drawn through the apertures 398 and into the main circuit passageway 366 to mix with the fuel in the main circuit passageway 366. The resultant air/fuel mixture in the main circuit passageway 366 is discharged directly into the air/fuel passageway 318 for use by the engine during part-throttle or full-throttle operation. The projection 360 occupies space in the air chamber 390 and therefore reduces the effective volume of the air chamber 390. In addition, because the projection 360 is in facing relationship with the outlet 510 of the main circuit air bleed passageway 502, the projection 360 facilitates distribution of the airflow entering the air chamber 390 throughout the air chamber 390.

Various features of the invention are set forth in the following claims.

What is claimed is:

1. A carburetor for use with an internal combustion engine, the carburetor comprising:

a body including an air/fuel passageway and a fuel passageway formed therein;

a throttle valve positioned in the air/fuel passageway;

a fuel bowl coupled to the body;

a fuel bowl chamber at least partially defined by the fuel bowl;

a one-piece fuel-metering insert coupled to the body, the insert including an idle circuit passageway having a first end in fluid communication with the fuel passageway and a second end in fluid communication with the fuel bowl chamber, the idle circuit passageway configured to carry fuel from the fuel bowl chamber to the air/fuel passageway via the fuel passageway during engine operation when the throttle valve is oriented in a substantially closed position; and a main circuit passageway having a first end in fluid communication with the air/fuel passageway and a second end in fluid communication with the fuel bowl chamber, the main circuit passageway configured to carry fuel from the fuel bowl chamber to the air/fuel passageway during engine operation when the throttle valve is opened from the substantially closed position.

2. The carburetor of claim 1, wherein the insert and the body are distinct components.

3. The carburetor of claim 2, wherein the insert and the body are coupled using at least one of a snap fit and an interference fit.

4. The carburetor of claim 1, wherein the body includes a hollow stem extending into the fuel bowl chamber, and wherein the insert is at least partially positioned within the stem.

5. The carburetor of claim 4, wherein the stem and the insert at least partially define a fuel reservoir within the stem, and wherein the second ends of the respective idle circuit passageway and the main circuit passageway are in fluid communication with the fuel bowl chamber via the fuel reservoir.

6. The carburetor of claim 5, further comprising an orifice positioned between the fuel bowl chamber and the fuel reservoir configured to meter fuel flow from the fuel bowl chamber to the fuel reservoir.

7. The carburetor of claim 6, further comprising a jet coupled to the insert, wherein the jet includes the orifice.

8. The carburetor of claim 6, wherein the orifice is a first orifice, wherein the carburetor further includes a second orifice positioned between the idle circuit passageway and the fuel passageway, and wherein the second orifice is configured to meter fuel flow from the idle circuit passageway to the fuel passageway.

9. The carburetor of claim 8, further comprising a jet coupled to the insert, wherein the jet includes the second orifice.

10. The carburetor of claim 4, wherein the stem and the insert at least partially define an air chamber within the stem, and wherein the main circuit passageway is at least partially positioned within the air chamber.

11. The carburetor of claim 10, wherein the insert includes a projection extending into the air chamber, and wherein the projection is configured to reduce the effective volume of the air chamber.

12. The carburetor of claim 10, wherein the insert includes at least one aperture fluidly communicating the idle circuit passageway and the air chamber.

13. The carburetor of claim 10, further comprising a seal positioned between the insert and the stem to fluidly separate the first end of the idle circuit passageway from the air chamber.

14. The carburetor of claim 10, further comprising a main circuit air bleed passageway formed in the body, and wherein the main circuit air bleed passageway is in fluid communication with the air chamber and is configured to supply air to the air chamber.

15. The carburetor of claim 14, wherein the main circuit air bleed passageway is formed in the body without machining the body.

16. The carburetor of claim 15, wherein the main circuit air bleed passageway includes at least two portions having respective longitudinal axes oriented substantially normal to each other.

17. The carburetor of claim 15, wherein the main circuit air bleed passageway includes a first portion having a main circuit air bleed inlet at one end and defining a first longitudinal axis, the main circuit air bleed inlet exposed to the air/fuel passageway;

a second portion having a main circuit air bleed outlet at one end and defining a second longitudinal axis, the main circuit air bleed outlet exposed to the air chamber; and an intermediate, third portion defining a third longitudinal axis and fluidly communicating the first and second portions, wherein the first, second, and third longitudinal axes are oriented mutually orthogonal to each other.

18. The carburetor of claim 17, further comprising a first plug at least partially positioned within the second portion of the main circuit air bleed passageway at a location disposed from the main circuit air bleed outlet; and a second plug at least partially positioned within the third portion of the main circuit air bleed passageway at a location disposed from an end of the third portion exposed to the second portion of the main circuit air bleed passageway.

19. The carburetor of claim 15, wherein the main circuit air bleed passageway includes a first portion having a main circuit air bleed inlet at one end and defining a first longitudinal axis, the main circuit air bleed inlet exposed to the air/fuel passageway;

a second portion having a main circuit air bleed outlet at one end and defining a second longitudinal axis, the main circuit air bleed outlet exposed to the air chamber, wherein the first and second longitudinal axes are oriented orthogonal to each other.

20. The carburetor of claim 19, further comprising an orifice positioned proximate the main circuit air bleed inlet, the orifice configured to meter the airflow into the main circuit air bleed passageway.

21. The carburetor of claim 20, further comprising a jet coupled to the body, wherein the jet includes the orifice.

22. The carburetor of claim 1, further comprising an idle circuit air bleed passageway in the body and oriented substantially parallel with the air/fuel passageway.

23. The carburetor of claim 22, wherein the idle circuit air bleed passageway is formed in the body without machining the body.

24. The carburetor of claim 22, wherein the idle circuit air bleed passageway includes an inlet exposed to an upstream portion of the air/fuel passageway; and an outlet exposed to a downstream portion of the air/fuel passageway.

25. The carburetor of claim 24, wherein the idle circuit air bleed passageway is in fluid communication with the fuel passageway at a location between the inlet and the outlet.

26. The carburetor of claim 25, wherein the idle circuit air bleed passageway and the fuel passageway include respective longitudinal axes that are substantially orthogonal to each other.

27. The carburetor of claim 25, wherein the fuel passageway is formed in the body without machining the body.

28. The carburetor of claim 24, further comprising an orifice positioned proximate the inlet of the idle circuit air bleed passageway, the orifice configured to meter the airflow into the idle circuit air bleed passageway.

29. The carburetor of claim 28, further comprising a jet coupled to the body, wherein the jet includes the orifice.

* * * * *